US012359869B2

(12) United States Patent
Cha et al.

(10) Patent No.: US 12,359,869 B2
(45) Date of Patent: Jul. 15, 2025

(54) REFRIGERATOR AND METHOD FOR CONTROLLING SAME

(71) Applicant: LG ELECTRONICS INC., Seoul (KR)

(72) Inventors: Kyunghun Cha, Seoul (KR); Namsoo Cho, Seoul (KR); Sunam Chae, Seoul (KR); Jaewon Eom, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 245 days.

(21) Appl. No.: 18/036,267

(22) PCT Filed: Nov. 10, 2021

(86) PCT No.: PCT/KR2021/016358
§ 371 (c)(1),
(2) Date: May 10, 2023

(87) PCT Pub. No.: WO2022/103154
PCT Pub. Date: May 19, 2022

(65) Prior Publication Data

US 2023/0408186 A1 Dec. 21, 2023

(30) Foreign Application Priority Data

Nov. 10, 2020 (KR) ..... 10-2020-0149427

(51) Int. Cl.
*F25D 29/00* (2006.01)

(52) U.S. Cl.
CPC ..... *F25D 29/005* (2013.01); *F25D 2600/02* (2013.01); *F25D 2700/121* (2013.01)

(58) Field of Classification Search
CPC .. F25D 29/00; F25D 2600/02; F25D 2700/12; F25D 2700/121
See application file for complete search history.

(56) References Cited

U.S. PATENT DOCUMENTS

2016/0290713 A1* 10/2016 Twiggar, III ..... F25D 23/02

FOREIGN PATENT DOCUMENTS

JP 2567764 12/1996
JP 2015-075310 4/2015
(Continued)

OTHER PUBLICATIONS

International Search Report dated Feb. 21, 2022 issued in Application No. PCT/KR2021/016358.

*Primary Examiner* — Jonathan Bradford
(74) *Attorney, Agent, or Firm* — KED & ASSOCIATES, LLP

(57) ABSTRACT

A refrigerator of the present embodiment includes: a cabinet having a storage compartment; a cooling apparatus which operates to cool the storage compartment; a temperature sensor for sensing a temperature of the storage space at a set time interval; and a controller for controlling the cooling apparatus, wherein the controller adjusts an output of the cooling apparatus on the basis of at least one of a first factor which is a difference value between a previous temperature of the storage compartment and a current temperature of the storage compartment and a second factor which is a difference value between a predetermined set temperature and a current temperature of the storage compartment, and adjusts the set time interval on the basis of at least one of the first factor and the second factor.

20 Claims, 13 Drawing Sheets

(56) References Cited

FOREIGN PATENT DOCUMENTS

| | | |
|---|---|---|
| JP | 2016-061520 | 4/2016 |
| KR | 10-2019-0005032 | 1/2019 |
| KR | 10-2020-0061767 | 6/2020 |

* cited by examiner

REFRIGERATOR AND METHOD FOR CONTROLLING SAME

CROSS-REFERENCE TO RELATED PATENT APPLICATIONS

This application is a U.S. National Stage Application under 35 U.S.C. § 371 of PCT Application No. PCT/KR2021/016358, filed Nov. 10, 2021, which claims priority to Korean Patent Application No. 10-2020-0149427, filed Nov. 10, 2020, whose entire disclosures are hereby incorporated by reference.

TECHNICAL FIELD

The present embodiments relate to a refrigerator and a method for controlling the same.

BACKGROUND ART

Refrigerators are home appliances that store foods at a low temperature. It is essential that a storage space is always maintained at a constant low temperature. At present, in the case of household refrigerators, the storage space is maintained at a temperature within the upper and lower limit ranges on the basis of a set temperature. That is, the refrigerator is controlled through a method in which when the storage space increases to the upper limit temperature, a refrigeration cycle operates to cool the storage space, and when the storage space reaches the lower limit temperature, the refrigeration cycle is stopped.

A refrigerator and a method for controlling the same are disclosed in Korean Patent Publication No. 10-2019-0005032, which is a prior art document.

The refrigerator of the prior art document includes: a cabinet having a storage space; a cooling apparatus which operates to supply cold air to the storage space; a temperature sensor that senses a temperature of the storage space; and a controller that controls an output of the cooling apparatus based on an increase or decrease of the temperature of the storage space sensed by the temperature sensor at regular time intervals and a difference value between a set temperature and a current temperature sensed by the temperature sensor.

According to prior art document, the temperature of the storage space is sensed at regular time intervals to adjust the output of the cooling apparatus. However, when a predetermined time interval is fixed, there is an advantageous in that the output of the cooling apparatus is not quickly adjusted in response to a rapid change in temperature until the predetermined time elapses.

In addition, in the case of the prior art document, it is disclosed that a sampling time is different according to a section of the current temperature, but a specific technique of varying in sample time based on the change in temperature is not disclosed.

DISCLOSURE OF THE INVENTION

Technical Problem

The present embodiment provides a refrigerator, in which a temperature of a storage space is maintained in a constant temperature state to freshness of an object to be stored, and a method for controlling the same.

Optionally or additionally, the present embodiment provides a refrigerator, in which power consumption of a cooling apparatus is capable of being reduced while being maintained in a constant temperature state in a storage space, and a method for controlling the same.

Optionally or additionally, the present embodiment provides a refrigerator in which a period of a set time for sensing a temperature is adjusted, and if a temperature of a storage space is out of a constant temperature state, the state is quickly restored in the constant temperature state, and a method for controlling the same.

Technical Solution

A refrigerator according to an aspect includes: a cabinet provided with a storage space; a cooling apparatus configured to operate in order to cool the storage space; a temperature sensor configured to sense a temperature of the storage space at a set time interval; and a controller configured to control the cooling apparatus.

The controller may be configured to adjust an output the cooling apparatus based on one or more of a first factor that is a difference value between a previous temperature of the storage space and a current temperature of the storage space and a second factor that is a difference value between a predetermined set temperature and the current temperature of the storage space.

The set time may be adjusted based on any one of the first factor and the second factor.

When an absolute value of the first factor or the second factor increases, the set time may decrease.

The set time may be determined by $a\times(\text{initial set time}/e_{t1})$, a may be greater than 0 and less than 1, and $e_{t1}$ may be the absolute value of the first factor or the second factor.

Any one time of a plurality of predetermined set times may be selected based on the absolute value of the first factor or the second factor.

When the absolute value of the first factor or the second factor is less than a first set value, an initial set time may be selected. When the absolute value of the first factor or the second factor is greater than the first set value and less than a second set value, a first set time less than the initial set time may be selected when the absolute value of the first factor or the second factor is greater than the second set value, a second set time less than the first set time may be selected.

Cooling capacity of the cooling apparatus may be determined by $MV_t=MV_{t-1}-K_p(e_t-e_{t-1})$.

$MV_t$ may be current cooling capacity of the cooling apparatus, $MV_{t-1}$ may be previous cooling capacity of the cooling apparatus, $K_p$ may be a P control gain value, $e_t$ may be a difference between the set temperature and the current temperature, and $e_{t-1}$ may be a difference between the set temperature and the previous temperature.

$K_p$ may be variable based on the first factor.

When an absolute value of the first factor is high, $K_p$ may increase, when an absolute of the first factor is low, $K_p$ may decrease.

Cooling capacity of the cooling apparatus may be determined by $MV_t=MV_{t-1}-K_i(e_t)$, $MV_t$ may be current cooling capacity of the cooling apparatus, $MV_{t-1}$ may be previous cooling capacity of the cooling apparatus, $K_i$ may be an I control gain value, and $e_t$ may be a difference between the set temperature and the current temperature. $K_i$ may be variable based on the second factor.

When an absolute value of the second factor is large, $K_i$ may increase, when an absolute of the first factor is small, $K_i$ may decrease.

A refrigerator according to another aspect includes: a cabinet provided with a storage space; a cooling apparatus configured to operate in order to cool the storage space; a temperature sensor configured to sense a temperature of the storage space at a set time interval; and a controller configured to control the cooling apparatus. The controller may be configured to adjust cooling capacity of the cooling apparatus based on a difference value between a previous temperature of the storage space and a current temperature of the storage space.

Cooling capacity of the cooling apparatus may be determined by $MV_t=MV_{t-1}-K_p(e_t-e_{t-1})$. $MV_t$ may be current cooling capacity of the cooling apparatus, $MV_{t-1}$ may be previous cooling capacity of the cooling apparatus, $K_p$ may be a P control gain value, $e_t$ may be a difference between the set temperature and the current temperature, and $e_{t-1}$ may be a difference between the set temperature and the previous temperature.

$K_p$ may be variable based on the difference value between the previous temperature of the storage space and the current temperature of the storage space.

When the difference value between the previous temperature of the storage space and the current temperature of the storage space is large, $K_p$ may increase. The difference value between the previous temperature of the storage space and the current temperature of the storage space is small, $K_p$ may decrease.

In a refrigerator according to further another aspect, the cooling capacity $VM_t$ of the cooling apparatus may be determined by $MV_t=MV_{t-1}-K_i(e_t)$.

$MV_t$ may be current cooling capacity of the cooling apparatus, $MV_{t-1}$ may be previous cooling capacity of the cooling apparatus, $K_i$ may be an I control gain value, and $e_t$ may be a difference between the set temperature and the current temperature. $K_i$ may be variable based on the second factor.

When the difference value between the set temperature and the current temperature of the storage space is large, $K_i$ may increase. The difference value between the set temperature and the current temperature of the storage space is small, $K_i$ may decrease.

A refrigerator according to further another aspect includes: a cabinet provided with a storage space; a cooling apparatus configured to operate in order to cool the storage space; a temperature sensor configured to sense a temperature of the storage space at a set time interval; and a controller configured to control the cooling apparatus. The controller may be configured to perform any one control of a constant temperature control and a normal control, during the constant temperature control, the controller may be configured to adjust an output the cooling apparatus based on one or more of a first factor that is a difference value between a previous temperature of the storage space and a current temperature of the storage space and a second factor that is a difference value between a predetermined set temperature and the current temperature of the storage space.

During the constant temperature control, if a constant temperature control termination condition may be satisfied, the normal control is performed. During the constant temperature control, the set time may be variable. During the normal control, the set time may be fixed.

During the normal control, if a constant temperature control start condition is satisfied, the constant temperature control may be performed.

The controller may be configured to allow the set time to be variable based on one or more of the first factor and the second factor.

A refrigerator according to further another aspect includes: a cabinet provided with a storage space in which a set temperature is set; a cooling apparatus configured to operate in order to cool the storage space; a temperature sensor configured to sense a temperature of the storage space at a set time interval; and a controller configured to control the cooling apparatus. The controller may be configured to perform any one control of a constant temperature control and a normal control. During the constant temperature control, the controller may be configured to adjust an output the cooling apparatus based on one or more of a first factor that is a difference value between a previous temperature of the storage space and a current temperature of the storage space and a second factor that is a difference value between a predetermined set temperature and the current temperature of the storage space.

The controller may be configured to control the cooling apparatus so that the set time when the set temperature is less than a limit temperature and the set time when the set temperature is equal to or greater than the limit temperature are different from each other.

When the set temperature is equal to or greater than the limit temperature, the set time may be fixed, and when the set temperature is less than the limit temperature, the set time may vary.

The set time when the set temperature is equal to or greater than the limit temperature may be greater than the set time when the set temperature is less than the limit temperature.

A variable range of the set time when the set temperature is equal to or greater than the limit temperature may be less than a variable range when the set temperature is less than the limit temperature.

A method for controlling a refrigerator according to further another aspect includes: allowing a cooling apparatus to operate at a predetermined output for a set time; sensing a temperature of a storage space when the set time elapses; allow a controller to determine an output of the cooling apparatus based a first factor that is a difference value between a previous temperature of the storage space and a current temperature of the storage space and a second factor that is a difference value between a set temperature and the current temperature of the storage space; and allowing the cooling unit to operate at the determined output.

The set time may be determined based on one or more of the first factor and the second factor.

Advantageous Effects

According to the proposed embodiment, the temperature of the storage space may be maintained in the constant temperature state to improve the freshness of the object to be stored.

According to the present embodiment, the power consumption of the cooling apparatus may be reduced while the temperature of the storage space is maintained in the constant temperature state.

According to the present embodiment, when the temperature of the storage space is out of the constant temperature state, the temperature of the storage space may be quickly restored to the constant temperature state.

MODE FOR CARRYING OUT THE INVENTION

Figure 1:
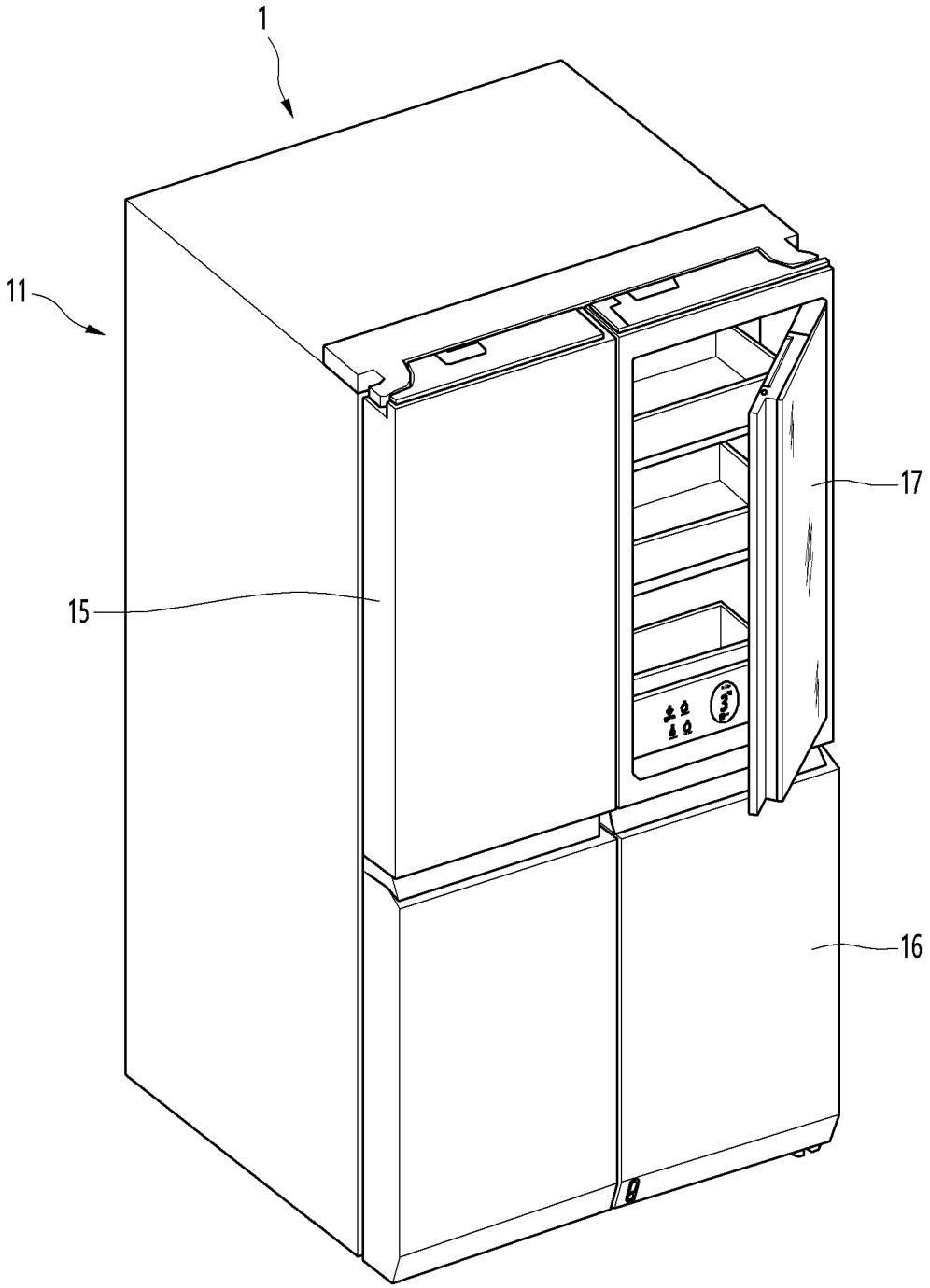
FIG. 1 is a perspective view of a refrigerator according to an embodiment of the present invention.

Hereinafter, some embodiments of the present invention will be described in detail with reference to the accompanying drawings. In adding of reference numerals to components of each drawing, it should be noted that the same components have the same numerals as much as possible even if the components are displayed on different drawings. In addition, in describing the embodiments of the present invention, if it is determined that a detailed description of a related known configuration or function disturbs understanding of the embodiment of the present invention, the detailed description will be omitted.

Also, in the description of the embodiments of the present invention, the terms such as first, second, A, B, (a) and (b) may be used. These terms are only used to distinguish the component from other components, and the essence, sequence, or order of the corresponding component is not limited by the term. It should be understood that when an element is described as being "connected," "coupled", or "joined" to another element, the former may be directly connected or jointed to the latter or may be "connected", coupled" or "joined" to the latter with a third component interposed therebetween.

Figure 2:
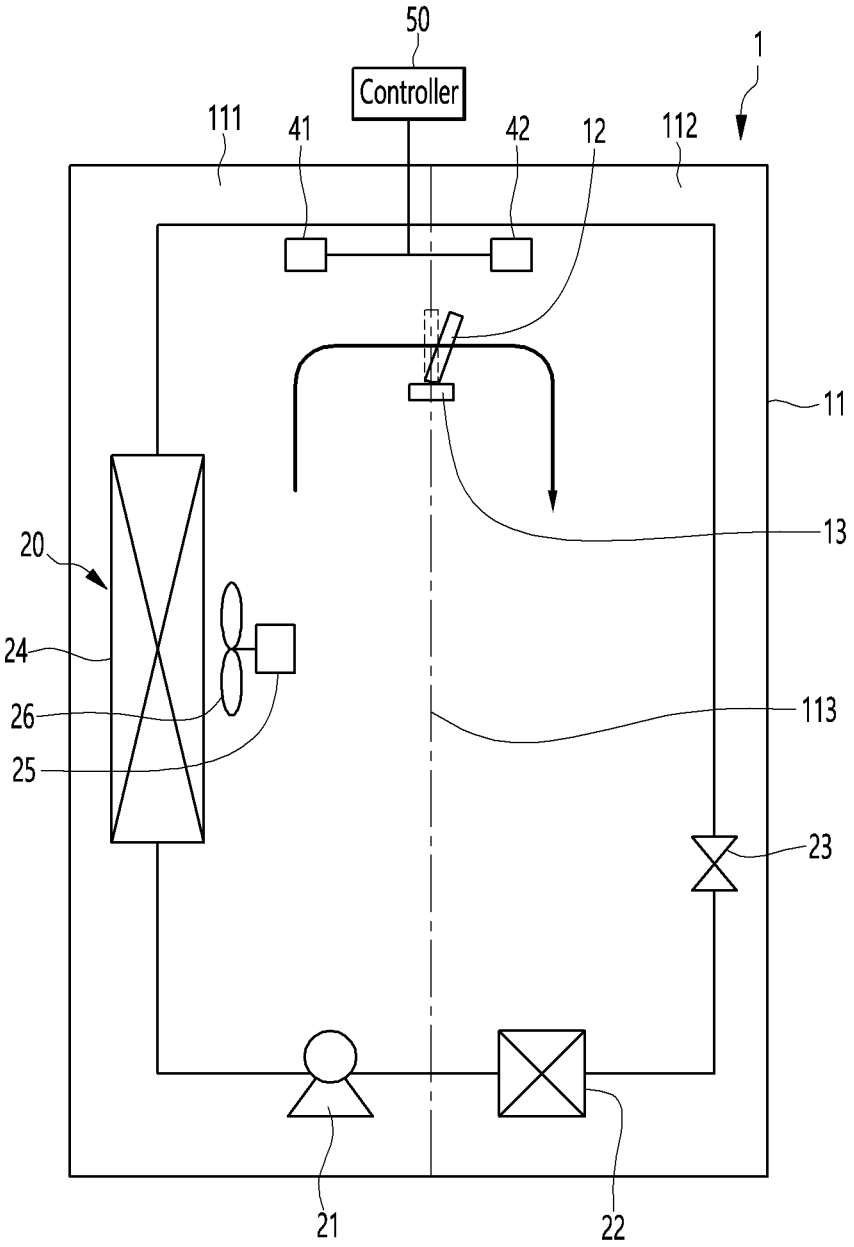
FIG. 2 is a schematic view illustrating a configuration of the refrigerator according to an embodiment of the present invention.
Figure 3:
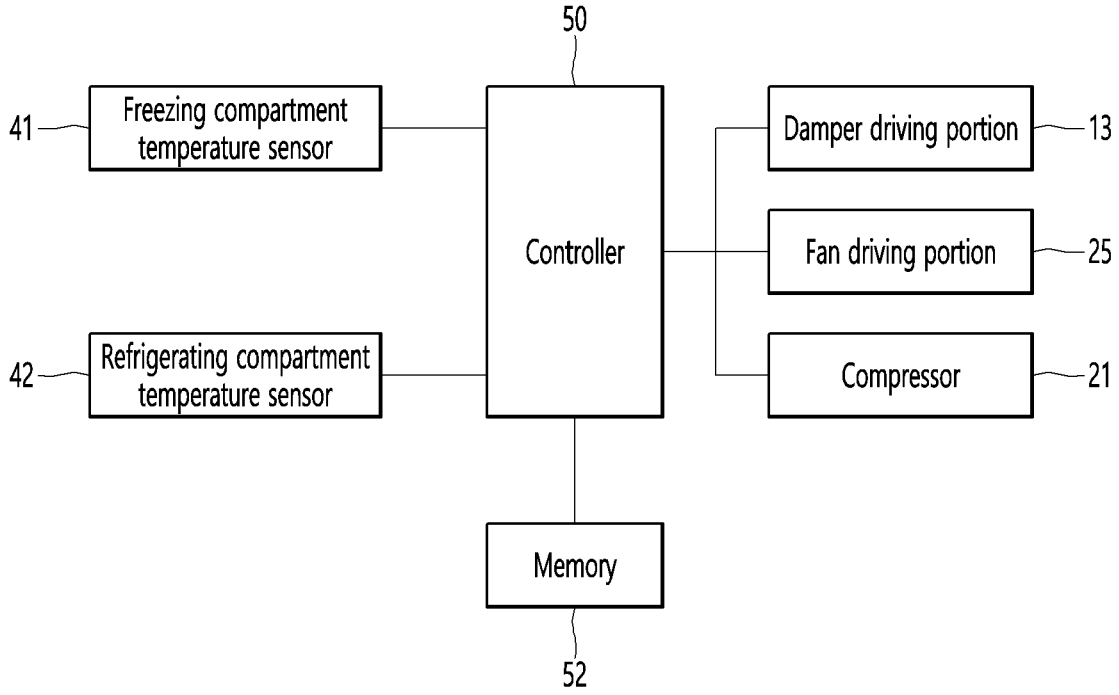
FIG. 3 is a block diagram illustrating the refrigerator according to the present invention.

FIG. 1 is a perspective view of a refrigerator according to an embodiment of the present invention, and FIG. 2 is a schematic view illustrating a configuration of the refrigerator according to an embodiment of the present invention. FIG. 3 is a block diagram illustrating the refrigerator according to the present invention.

Referring to FIGS. 1 to 3, a refrigerator 1 according to an embodiment of the present invention may include a cabinet 11 defining a storage space and a storage space door that opens and closes the storage space of the cabinet 11.

The storage space may include a freezing compartment 111 and a refrigerating compartment 112. The freezing compartment 111 and the refrigerating compartment 112 may store articles such as foods.

The freezing compartment 111 and the refrigerating compartment 112 may be horizontally or vertically partitioned within the cabinet 11 by a partition wall 113.

The storage space door may include a freezing compartment door 15 for opening and closing the freezing compartment 111 and a refrigerating compartment door 16 for opening and closing the refrigerating compartment 112. Although not limited, the refrigerating compartment door 16 may further include a sub door 17 for withdrawing the articles stored in the refrigerating compartment 112 without opening the refrigerating compartment door 16.

A connection duct (not shown) providing a cold air passage through which cold air is supplied to the storage space 112 may be provided in the partition wall 113, and a damper 12 may be installed in the connection duct (not shown) to open or close the connection duct.

The refrigerator 1 may further include a refrigeration cycle 20 for cooling the freezing compartment 111 and/or the refrigerating compartment 112.

The refrigeration cycle 20 may include a compressor compressing a refrigerant, a condenser condensing the refrigerant passing through the compressor 21, an expansion member 23 expanding the refrigerant passing through the condenser 22, and an evaporator 24 evaporating the refrigerant passing through the expansion member 23. The evaporator 24 may include, for example, an evaporator for the freezing compartment.

The refrigerator 1 may include a fan 26 for allowing air to flow toward the evaporator 24 to circulate cool air in the freezing compartment 111 and a fan driving portion 25 for driving the fan 26.

In order to supply the cool air to the freezing compartment 111 in the present embodiment, the compressor 21 and the fan driving portion 25 have to operate. In order to supply the cool air to the refrigerating compartment 112, the damper 12 has to be opened as well as the compressor 21 and the fan driving portion 25 operate. Here, the damper 12 may operate by the damper driving portion 13.

In this specification, the compressor 21, the fan driving portion 25, and the damper 12 (or the damper driving portion) may be referred to as a "cooling apparatus" that operate to cool the storage space. For example, the cooling apparatus may include a cold air generating means for generating cold air and a cold air transfer means for transferring cold air. The cold air generating means may include the compressor 21, and the cold air transfer means may include the fan 26 (or fan driving portion) and/or the damper 12 (or damper driving portion).

In this specification, when the cooling apparatus is the compressor 21 and the fan driving portion 25, "the cooling apparatus operates or is turned on" means that the compressor 21 and the fan driving portion 25 are turned on, and "the cooling apparatus is stopped or turned on" means that the compressor 21 and the fan driving portion 25 are turned off.

In this specification, when the cooling apparatus is the compressor 21 and the fan driving portion 25, an output of the cooling apparatus may mean a cooling capacity of the compressor 21 and a rotation speed of the fan driving portion 25.

When the cooling apparatus is the damper 12, "the cooling apparatus operates or is turned on" means that the damper 12 opens a passage of the duct so that cold air in the freezing compartment 111 is capable of flowing into the refrigerating compartment 112, "the cooling apparatus is stopped or turned off" means that the damper 12 closes the passage so that the cold air in the freezing compartment 111 does not flow into the refrigerating compartment 112.

When the cooling apparatus is the damper 12 (or damper driving portion), an increase in output of the cooling apparatus may mean that an opening angle of the damper 12 increases, and a decrease in output of the cooling apparatus may mean that the opening angle of the damper 12 decreases.

The refrigerator 1 may further include a freezing compartment temperature sensor 41 for sensing a temperature of the freezing compartment 111, a refrigerating compartment temperature sensor 42 for sensing a temperature of the refrigerating compartment 112, and a controller 50 for controlling the cooling apparatus based on the temperature sensed by each of the temperature sensors 41 and 42.

The controller 50 may control one or more of the compressor 21 and the fan driving portion 25 to maintain the temperature of the freezing compartment 111 to a target temperature.

For example, the controller 50 may increase, maintain, or decrease the outputs of the fan driving portion 25 and the compressor 21.

The controller 50 may increase, maintain, or decrease one or more outputs of the compressor 21, the fan driving portion 25, and the damper 12 (or the damper driving portion 13) to maintain the temperature of the refrigerating compartment 112 to a target temperature.

For example, the controller 50 may allow an opening angle of the damper 12 to vary while each of the compressor 21 and the fan driving portion 25 operate at a certain output.

A set temperature (or target temperature) may be stored in the memory 52. The memory 52 may store a change in unit cooling capacity according to a unit temperature.

In this specification a temperature greater than that target temperature of the refrigerating compartment 112 may be called a first refrigerating compartment reference temperature, and a temperature less than the target temperature of the refrigerating compartment 112 may be called a second refrigerating compartment reference temperature.

A temperature greater than that target temperature of the freezing compartment 111 may be called a first freezing compartment reference temperature, and a temperature less than the target temperature of the freezing compartment 111 may be called a second freezing compartment reference temperature.

A range between the first refrigerating compartment reference temperature and the second refrigerating compartment reference temperature may be called a freezing compartment temperature satisfaction section. A predetermined temperature between the first refrigerating compartment reference temperature and the second refrigerating compartment reference temperature may be referred to as a first set temperature. The first set temperature may be a target temperature or an average temperature of the first refrigerating compartment reference temperature and the second refrigerating compartment reference temperature.

A range between the first freezing compartment reference temperature and the second freezing compartment reference temperature may be called a freezing compartment temperature satisfaction section. A predetermined temperature between the first freezing compartment reference temperature and the second freezing compartment reference temperature may be referred to as a second set temperature. The second set temperature may be a target temperature or an average temperature of the first freezer compartment reference temperature and the second freezer compartment reference temperature.

The controller 50 may control the cooling apparatus so that the temperature of the freezing compartment 111 and/or the refrigerating compartment 112 is maintained within the temperature satisfaction section.

Hereinafter, a method for controlling a constant temperature of the storage space will be described.

Figure 4:
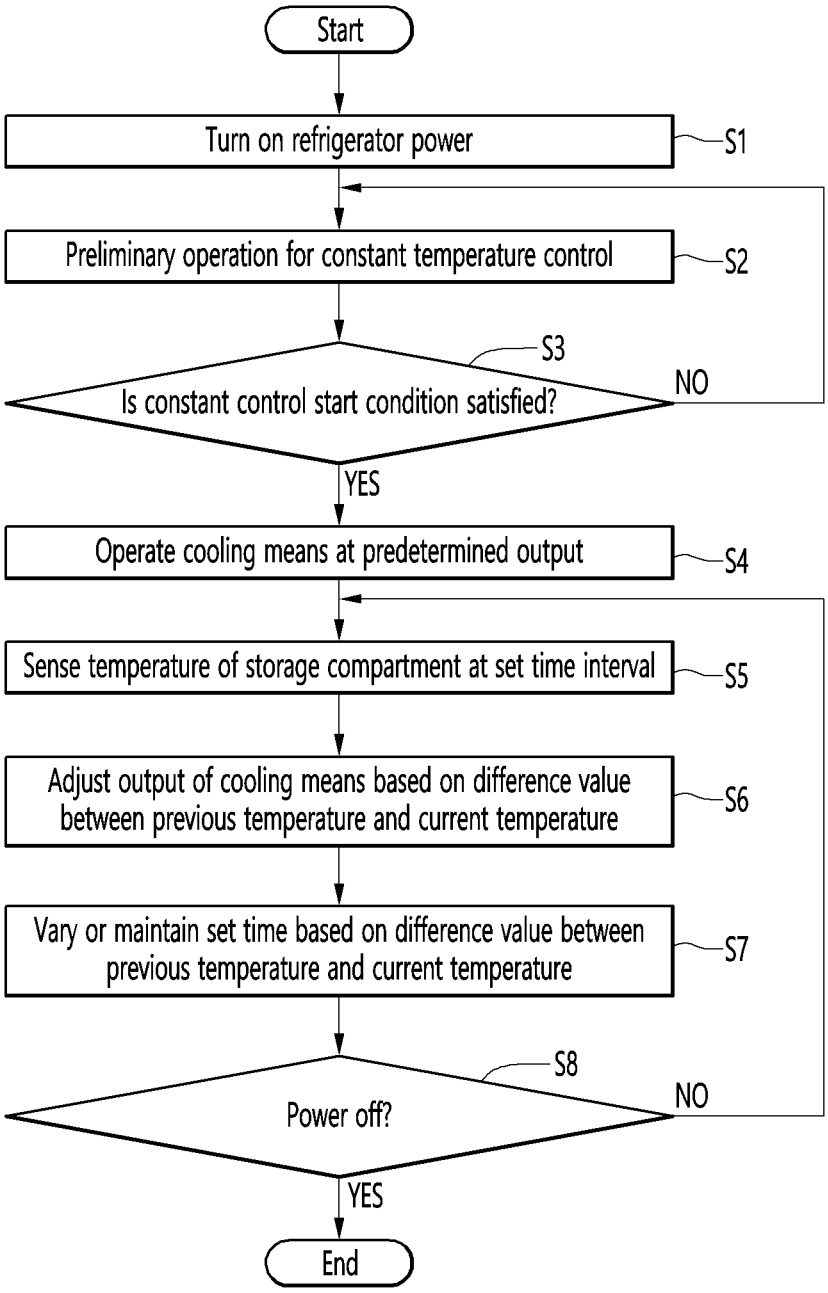
FIG. 4 is a flowchart illustrating a method for controlling a refrigerator according to a first embodiment of the present invention.

FIG. 4 is a flowchart illustrating a method for controlling a refrigerator according to a first embodiment of the present invention.

Referring to FIG. 4, a method for controlling a refrigerator according to the present embodiment may include a general control and a constant temperature control.

The general control is a control for rapidly lowering a temperature of a storage space, and the constant temperature control is a control for maintaining the temperature of the storage space within a temperature satisfaction section.

When power of the refrigerator 1 is turned on (S1), a controller 50 may perform a preliminary operation for the constant temperature control (S2). The preliminary operation may be included in the general control.

In this specification, the cooling apparatus may be turned on when the temperature of the storage space is equal to or greater than an on-reference temperature A1, and turned off when the temperature of the storage space is equal to or less than an off-reference temperature A2.

In general, when the refrigerator 1 is turned on, or the cooling apparatus is turned on in a state in which the power of the refrigerator 1 is turned off, or the cooling apparatus is turned off for defrosting, the temperature of the storage space may be higher than the on-reference temperature A1, and thus, the controller 50 may allow the cooling apparatus to operate at a predetermined first output value (or first cooling capacity) so that the temperature of the storage space quickly drops. The first output value may be, for example, a maximum output or an output less than the maximum output.

For example, the controller 50 may control the compressor 21 to operate at the maximum cooling capacity and may set the opening angle of the damper 12 to a maximum value.

When the compressor 21 operates at the maximum cooling capacity, the temperature of the storage space may decrease, and when the temperature of the storage space is less than off-reference temperature A2, the controller 50 may stop the compressor 21. Alternatively, the controller 50 may close the damper 12.

That is, the preliminary operation process may include a process of operating the cooling apparatus at the maximum output and a process of stopping the cooling apparatus.

During the preliminary operation of the refrigerator, the controller 50 determines whether a constant temperature control start condition is satisfied (S3).

For example, the controller 50 may determine whether the temperature of the storage space has reached a set temperature in a state in which the cooling apparatus is stopped.

When the cooling apparatus is stopped, the temperature of the storage space may rise, and when the temperature of the storage space reaches the set temperature, the controller 50 may determine that the constant temperature control start condition is satisfied to perform the control for the constant temperature of the storage space. Alternatively, it may be determined that the constant temperature control start condition is satisfied when the cooling apparatus is stopped, and a predetermined time elapses. Alternatively, the constant temperature control may be started immediately when the cooling apparatus is stopped. In this case, the operation S3 may be omitted.

When the constant temperature control start condition is satisfied, the cooling apparatus may operate at a predetermined output (a second output value less than the first output value) (S4). The predetermined output is an output between a minimum output and a maximum output.

In the constant temperature control process, the cooling apparatus may continuously operate.

The constant temperature control process may include a process of sensing the temperature of the storage space at set time intervals (S5) and a process of adjusting the output of the cooling apparatus (S6).

In the present embodiment, the controller 50 may adjust the output of the cooling apparatus to control the constant temperature of the storage space, but may adjust the output of the cooling apparatus based on the temperature of the storage space.

The controller 50 may adjust the output of the cooling apparatus according to the trend of the temperature change in the storage space.

In the present embodiment, as the trend of the temperature change of the storage space, the output of the cooling apparatus may be adjusted using a difference between the previous storage space temperature (hereinafter, referred to as a "previous temperature") and a current storage space temperature (hereinafter, referred to as a "current temperature") (S6).

The controller 50 may allow the set time to vary based on the difference between the previous temperature and the current temperature of the storage space (S7).

The temperature change of the storage space is based on a temperature value of the storage space sensed at a set time interval (or an interval of a set time). Therefore, the set time is a sampling time for determining the trend of the temperature change.

At the beginning of the constant temperature control process, the temperature change of the storage space may be sensed at a predetermined set time interval. The initially used set time may be referred to as an initial set time. Although not limited, the initial set time may be maximum.

The set time ST may be determined by ST=a×(initial set time/$e_t$). In this case, a is a value greater than 0 and less than 1, and $e_t$ is an absolute value of the difference between the previous temperature and the current temperature (for example, the first factor).

As another example, a plurality of set times including the initial set time may be stored in the memory 52 in advance, and one of the plurality of set times may be selected based on the difference between the previous temperature and the current temperature of the storage space.

The difference value and the set time may be in inverse proportion to each other. As the difference value increases, the set time may be shortened.

That the set time decreases means that a period for which the output of the cooling apparatus is adjusted decreases, and in this case, it is possible to quickly respond to the temperature change in the storage space.

In summary, whenever the set time elapses, the output of the cooling capacity of the cooling apparatus may be determined, and the set time to be applied next time may be determined.

The controller 50 continues the constant temperature control unless the power of the refrigerator 1 is turned off (S8).

Figure 5:
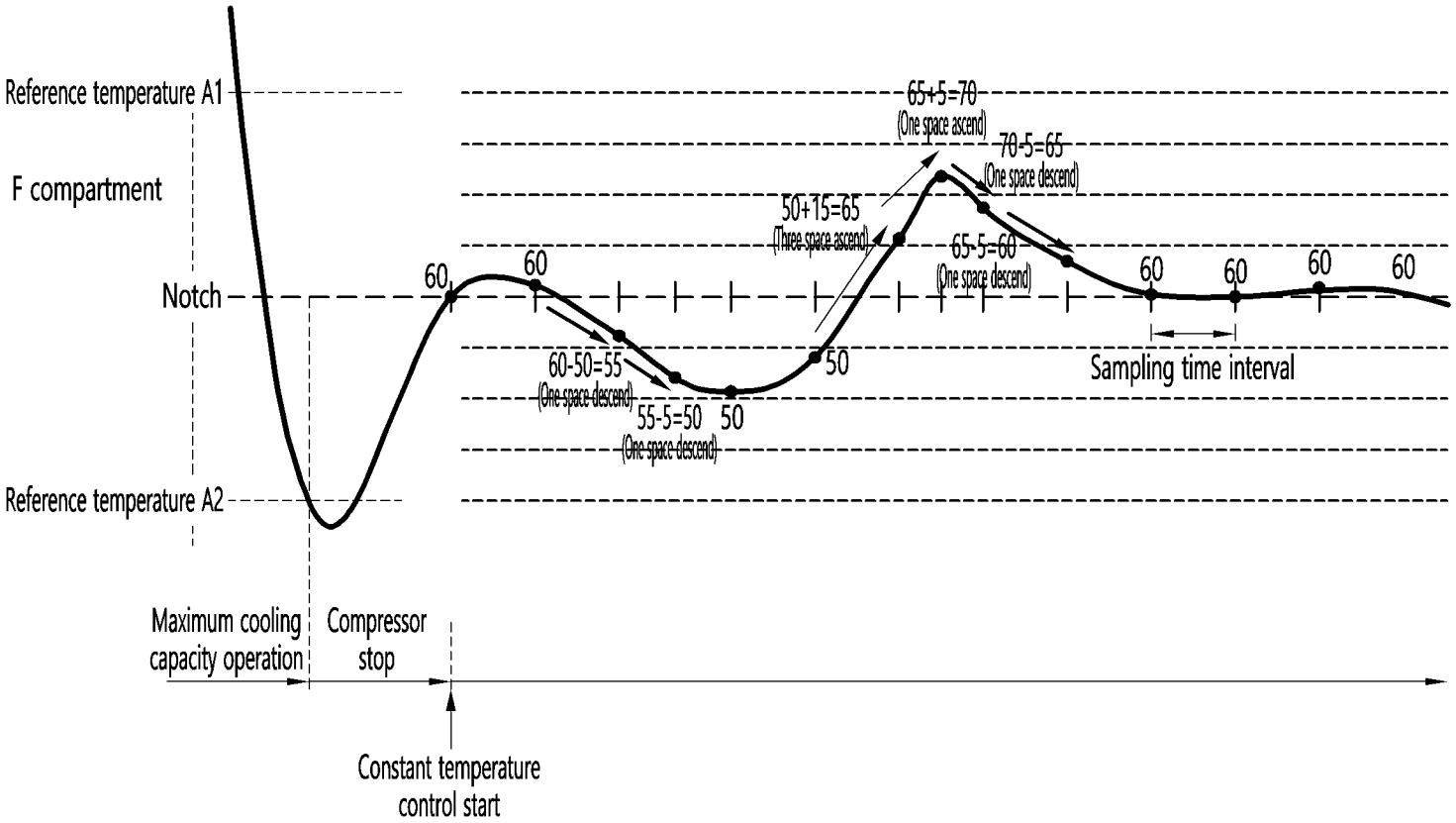
FIG. 5 is a graph for explaining a temperature change of a storage space and an output control of a cooling apparatus according to the first embodiment.

FIG. 5 is a graph for explaining the temperature change of the storage space and the output control of the cooling apparatus according to the first embodiment.

For example, FIG. 5 illustrates a change in cooling capacity of the compressor for maintaining the freezing compartment at a constant temperature and a corresponding change in temperature of the freezing compartment, and the numbers in the graph are examples of the cooling capacity of the compressor.

Hereinafter, a process of controlling the cooling capacity of the compressor as an example of the cooling apparatus will be described.

Referring to FIG. 5, after the power of the refrigerator is turned on, or the defrosting operation is completed, the compressor 21 may operate at the maximum cooling capacity to quickly lower the temperature of the freezing compartment. When the temperature of the freezing compartment reaches the off-reference temperature A2, the compressor 21 is stopped.

When the compressor 21 is stopped, the temperature of the freezing compartment rises, and when the temperature of the freezing compartment reaches a set temperature (notch), the control for the constant temperature of the freezing compartment may start.

When the constant temperature control of the freezing compartment starts, the compressor 21 operates with a preset cooling capacity between a minimum cooling capacity and a maximum cooling capacity.

As described above, the temperature of the freezing compartment is sensed at the set time interval, and the controller 50 may adjust the cooling capacity of the compressor 21 based on the difference between the previous temperature and the current temperature.

Although not limited, the cooling capacity of the compressor 21 may be determined by $MV_t=MV_{t-1}-K_p(e_t-e_{t-1})$. Where $MV_t$ is the current cooling capacity of the cooling apparatus, $MV_{t-1}$ is the previous cooling capacity of the cooling apparatus, $K_p$ is a P control gain value, $e_t$ is a difference between the set temperature and the current temperature, and $e_{t-1}$ is a difference between the set temperature and the previous temperature. As a result, $(e_t-e_{t-1})$ is the difference between the previous temperature and the current temperature.

In the case of an embodiment, $K_p$ may be a fixed value as a gain value. Alternatively, $K_p$ may vary based on the difference between the previous temperature and the current temperature.

For example, if the absolute value of the difference between the previous temperature and the current temperature is high, $K_p$ may increase, and if the absolute value of the difference between the previous temperature and the current temperature is low, $K_p$ may decrease.

When $K_p$ increases, a range in change of the cooling capacity of the compressor 21 may be large, and when $K_p$ decreases, a range in change of the cooling capacity of the compressor 21 may be small.

While the compressor 21 operates at a cooling capacity of 60, the cooling capacity may be maintained (cooling capacity: 60), decrease (cooling capacity: 55 or 50), or increase (cooling capacity: 65 or 70) according to the temperature of the freezing compartment.

For example, when the absolute value of the difference between the previous temperature and the current temperature is less than a first reference value, the controller 50 may maintain the cooling capacity of the compressor 21.

Alternatively, when the absolute value of the difference between the previous temperature and the current temperature is greater than or equal to the first reference value, the cooling capacity of the compressor 21 may increase or decrease.

For example, when the difference between the previous temperature and the current temperature is greater than 0, and the absolute value of the difference between the previous temperature and the current temperature is equal to or greater than the first reference value, the cooling capacity of the compressor 21 may decrease by a first level.

Alternatively, when the difference between the previous temperature and the current temperature is less than 0, and the absolute value of the difference between the previous temperature and the current temperature is greater than or equal to a first reference value, the cooling capacity of the compressor 21 may increase by the first level.

In the present embodiment, the reference value for comparing the difference between the previous temperature and the current temperature with the absolute value may be set in plurality.

For example, when the difference between the previous temperature and the current temperature is greater than 0, and the absolute value of the difference between the previous temperature and the current temperature is equal to or greater than a second reference value greater than the first reference value, the cooling capacity of the compressor 21 may decrease by a second level. In addition, when the absolute value of the difference between the previous temperature and the current temperature is greater than or equal to a third reference value greater than the second reference value, the cooling capacity of the compressor 21 may decrease by a third level.

Alternatively, when the difference between the previous temperature and the current temperature is less than 0, and the absolute value of the difference between the previous temperature and the current temperature is greater than or equal to a second reference value greater than the first reference value, the cooling capacity of the compressor 21 may increase by the second level. In addition, when the absolute value of the difference between the previous temperature and the current temperature is greater than or equal to the third reference value greater than the second reference value, the cooling capacity of the compressor 21 may increase by the third level.

In this case, the difference value between the plurality of reference values may be set to be the same or different.

For example, the first reference value may be set to 0.5, the second reference value may be set to 1, and the third reference value may be set to 1.5. Alternatively, the first reference value may be set to 0.5, the second reference value may be set to 0.9, and the third reference value may be set to 1.3.

Alternatively, a difference value between the plurality of levels may be set to be the same or different.

For example, the first level may be set to a cooling capacity change value A, the second level may be set to a cooling capacity change value 2*A, and the third level may be set to a cooling capacity change value 3*A. Alternatively, the first level may be set to a cooling capacity change value of A, the second level may be set to a cooling capacity change value B (value greater than A) rather than 2*A, and the third level may be set to a cooling capacity change value C (value greater than B) rather than 3*A.

In a state in which the cooling capacity of the compressor 21 decreases (for example, the cooling capacity is 55), the current temperature may be sensed after the sampling time, and if the difference between the previous temperature and the current temperature is greater than 0, and the difference between the previous temperature and the current temperature is greater than the first reference value, the cooling capacity of the compressor 21 may decrease again (for example, the cooling capacity is 50).

In addition, in a state in which the cooling capacity of the compressor 21 increases (for example, the cooling capacity is 65), the current temperature may be sensed after the sampling time, and if the difference between the previous temperature and the current temperature is less than 0, and the difference between the previous temperature and the current temperature is greater than the first reference value, the cooling capacity of the compressor 21 may increase again (for example, the cooling capacity is 70).

As described above, as the temperature of the storage space is sensed at each set time interval, and the cooling capacity of the cooling apparatus is adjusted, the temperature of the storage space converges to the set temperature as long as there is no influence of external factors.

Also, as described above, the set time may be determined every time the set time elapses.

As a first example, the set time may be changed in response to the absolute value of the difference between the previous temperature and the current temperature.

Alternatively, as a second example, when the absolute value of the difference between the previous temperature and the current temperature is less than the first set value, the initial set time is selected, and when the absolute value of the difference between the previous temperature and the current temperature is greater than the first set value and less than the second set time, a first set time shorter than the initial set time may be selected. When the absolute value of the difference between the previous temperature and the current temperature is greater than the second set value, a second set time less than the first set time may be selected. FIG. 5 illustrates a second example as an example.

Figure 6:
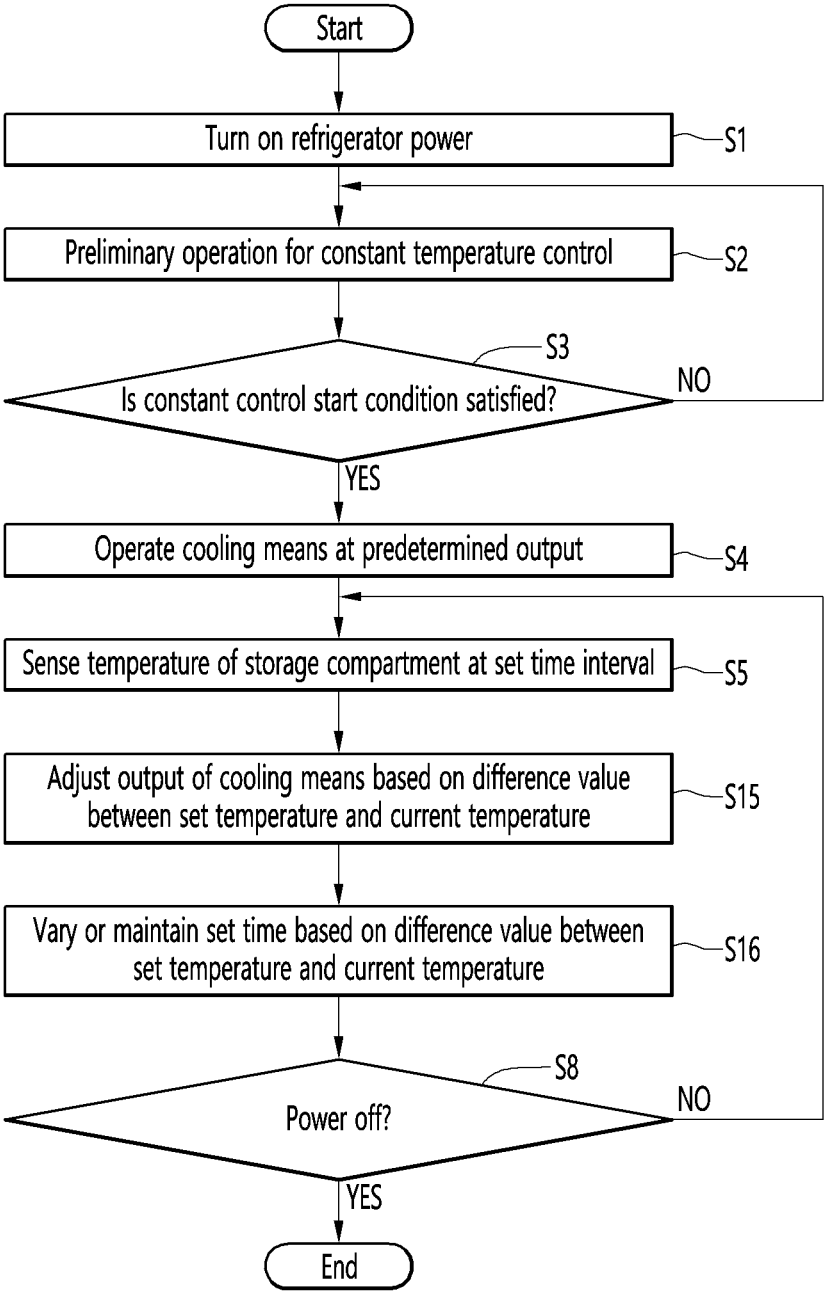
FIG. 6 is a flowchart for explaining a method for controlling a refrigerator according to a second embodiment of the present invention.

FIG. 6 is a flowchart for explaining a method for controlling a refrigerator according to a second embodiment of the present invention.

The present embodiment is the same as the previous embodiment in other portions, but is characterized in that the type of factors for controlling the refrigerator is different. Thus, only characterized portions in the present embodiment will be described below.

Referring to FIG. 6, operations S1 to S4 previously described in the first embodiment are equally applied to a control method according to the present embodiment.

That is, when a refrigerator is turned on, a preliminary operation is performed, and the compressor is stopped. Then, when it is determined that a constant temperature control start condition is satisfied, a constant temperature control for a constant temperature of a storage space is performed.

In this case, when the constant temperature control start condition is satisfied, a temperature of the storage space may reach a specific temperature within a temperature satisfaction section to be described later. For example, when the temperature of the storage space reaches a set temperature of the storage space, the compressor may operate.

In the present embodiment, the constant temperature control process may include a process of sensing the temperature of the storage space at set time intervals (S5) and a process of adjusting an output of a cooling apparatus (S15).

For example, the controller 50 adjusts the output of the cooling apparatus using a difference between the set temperature and the current temperature of the storage space (S15).

Here, the controller 50 may sense the current temperature of the storage space at a set time interval to adjust the output of the cooling apparatus based on whether an absolute value of the difference between the set temperature and the current temperature is less than a first upper limit reference value or a first lower limit reference value.

For example, a temperature greater than the set temperature by the first upper limit reference value may be referred to as an upper temperature limit (reference temperature C1), and a temperature less than the set temperature by the first lower limit reference value may be referred to as a lower temperature limit (reference temperature C2).

The first upper limit reference value and the first lower limit reference value may be set to be the same or different.

Each of the first upper limit reference value and the first lower limit reference value may be set to 0.5, or the first upper limit reference value may be set to be greater than or less than the first lower limit reference value.

When the absolute value of the difference between the set temperature and the current temperature is less than the first lower limit reference value or the first upper and lower reference values, the current temperature may be less than the upper temperature limit and greater than the lower temperature limit.

Thus, a case in which the current temperature is less than the upper temperature limit and greater than the lower temperature limit will be described as being disposed in the temperature satisfaction section.

In addition, a case in which the current temperature is greater than the upper temperature limit is described as being disposed in the upper temperature section exceeding the current temperature, and a case in which the current temperature is less than the lower temperature limit is described as being disposed in a section in which the current temperature exceeds the lower temperature limit.

In this case, the upper temperature limit is a temperature value less than an on-reference temperature A1 and greater than the set temperature, and the lower temperature limit is a temperature value greater than an off-reference temperature A2 and less than the set temperature.

The controller 50 may allow the set time to vary based on the difference between the set temperature and the current temperature (S16).

The temperature change of the storage space is based on a temperature value of the storage space sensed at a set time interval. Therefore, the set time is a sampling time for determining the trend of the temperature change.

At the beginning of the constant temperature control process, the temperature change of the storage space may be sensed at a predetermined set time interval. The initially used set time may be referred to as an initial set time. Although not limited, the initial set time may be maximum.

The set time ST may be determined by ST=a×(initial set time/$e_{t1}$). Here, a is a value greater than 0 and less than 1, and $e_{t1}$ is an absolute value of the difference between the set temperature and the current temperature.

As another example, a plurality of set times including the initial set time may be stored in the memory 52 in advance, and one of the plurality of set times may be selected based on the difference between the set temperature and the current temperature.

The difference value and the set time may be in inverse proportion to each other. As the difference value increases, the set time may be shortened.

That the set time decreases means that a period for which the output of the cooling apparatus is adjusted decreases, and in this case, it is possible to quickly respond to the temperature change in the storage space.

In summary, whenever the set time elapses, the output of the cooling capacity of the cooling apparatus may be determined, and the set time to be applied next time may be determined.

The controller 50 continues the constant temperature control unless the power of the refrigerator 1 is turned off (S8).

Figure 7:
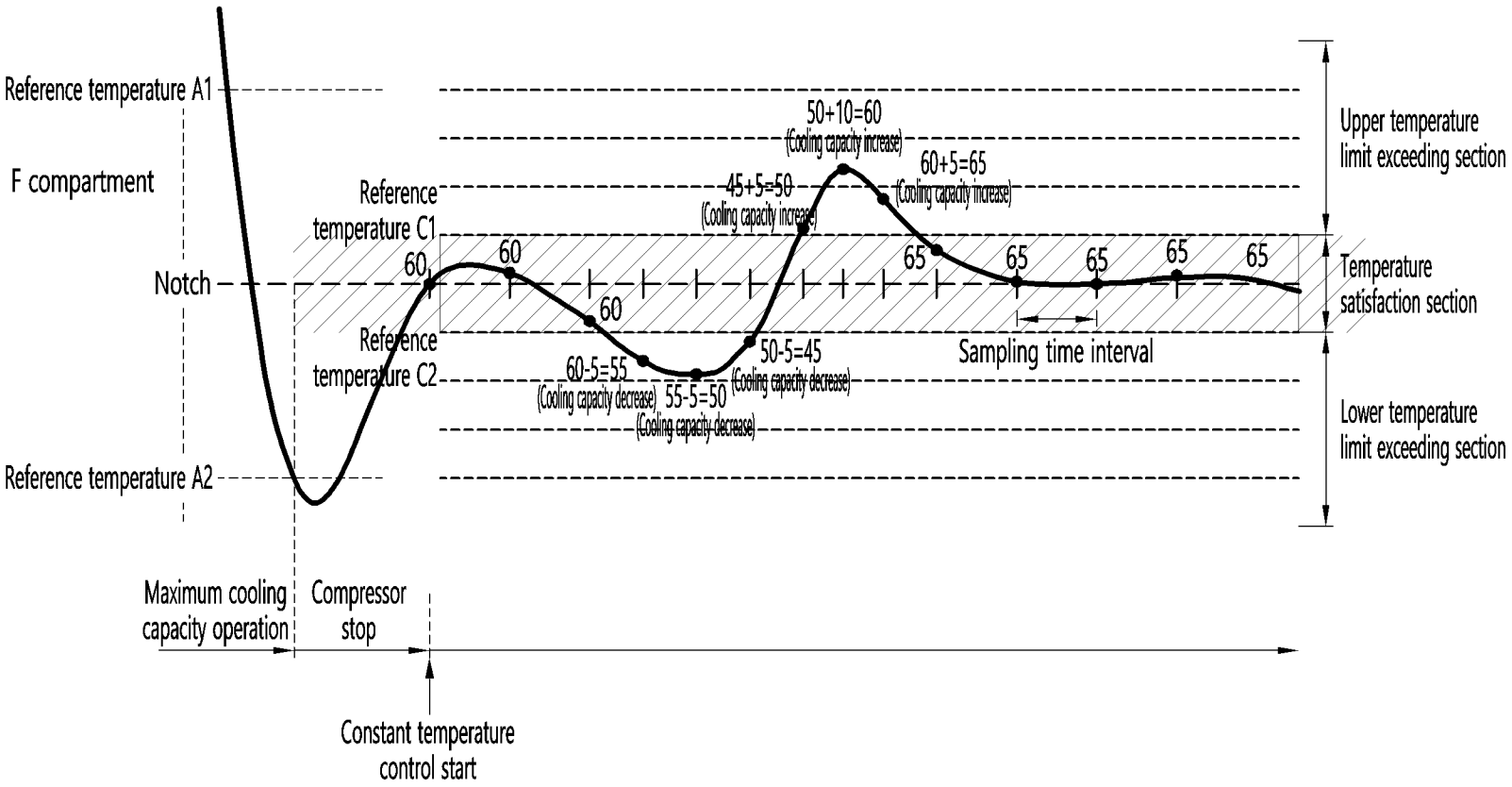
FIG. 7 is a graph for explaining a temperature change of a storage space and an output control of a cooling apparatus according to the second embodiment.

FIG. 7 is a graph for explaining a temperature change of the storage space and the output control of the cooling apparatus according to the second embodiment.

For example, FIG. 7 illustrates a change in cooling capacity of the compressor for maintaining the freezing compartment at a constant temperature and a corresponding change in temperature of the freezing compartment, and the numbers in the graph are examples of the cooling capacity of the compressor.

Hereinafter, a process of controlling the cooling capacity of the compressor as an example of the cooling apparatus will be described.

Referring to FIG. 7, after power of the refrigerator is turned on, or a defrosting operation is completed, the compressor 21 may operate at a maximum cooling capacity to quickly lower the temperature of the freezing compartment. When the temperature of the freezing compartment reaches the off-reference temperature A2, the compressor 21 is stopped.

When the compressor 21 is stopped, the temperature of the freezing compartment rises, and when the temperature of the freezing compartment reaches a set temperature (notch), the control for the constant temperature of the freezing compartment may start.

When the constant temperature control of the freezing compartment starts, the compressor 21 operates with a preset cooling capacity between a minimum cooling capacity and a maximum cooling capacity.

As described above, the temperature of the freezing compartment is sensed at the set time interval, and the controller 50 may adjust the cooling capacity of the compressor 21 based on the difference between the previous temperature and the current temperature.

Although not limited, the cooling capacity of the compressor 21 may be determined by $MV_t=MV_{t-1}-K_i(e_t)$. Here, $MV_t$ is the current cooling capacity of the cooling apparatus, $MV_{t-1}$ is the previous cooling capacity of the cooling apparatus, $K_i$ is an I control gain value, and $e_t$ is a difference between the set temperature and the current temperature (for example, a second factor).

In one embodiment, $K_i$ may be a fixed value as a gain value. Alternatively, $K_i$ may vary based on the difference between the set temperature and the current temperature.

For example, if the absolute value of the difference between the set temperature and the current temperature is high, $K_i$ may increase, and if the absolute value of the difference between the set temperature and the current temperature is low, $K_i$ may decrease.

When $K_i$ increases, a range in change of the cooling capacity of the compressor 21 may be large, and when $K_i$ decreases, a range in change of the cooling capacity of the compressor 21 may be small.

For example, while the compressor 21 operates at a cooling capacity of 60, the cooling capacity may be maintained (cooling capacity: 60), decrease (cooling capacity: 55 or 50), or increase (cooling capacity: 65) according to the temperature of the freezing compartment.

For example, when the absolute value of the difference between the set temperature and the current temperature is less than the first upper limit reference value or the first lower limit reference value, the controller 50 may maintain the cooling capacity of the compressor 21.

For example, when the current temperature is disposed in the temperature satisfaction section, the cooling capacity of the compressor 21 may be maintained.

On the other hand, when the current temperature is disposed in a section exceeding the upper temperature limit, the cooling capacity of the compressor 21 may increase. In addition, when the current temperature is disposed in a section exceeding the lower temperature limit, the cooling capacity of the compressor 21 may decrease.

For example, when the absolute value of the difference between the set temperature and the current temperature is greater than the first lower limit reference value and less than the second lower limit reference value while the current temperature is disposed in the section exceeding the lower temperature limit, the compressor 21 cooling capacity may decrease by a first level.

Alternatively, when the absolute value of the difference between the set temperature and the current temperature is greater than the second lower limit reference value and less than the third lower limit reference value while the current temperature is disposed in the section exceeding the lower temperature limit, the cooling capacity of the compressor 21 may decrease by a second level.

Alternatively, when the absolute value of the difference between the set temperature and the current temperature is equal to or greater than a third lower limit reference value while the current temperature is disposed in the section exceeding the lower temperature limit, the cooling capacity of the compressor 21 may decrease by a third level.

Here, the second lower limit reference value is greater than the first lower limit reference value, and the third lower limit reference value is greater than the second lower limit reference value.

For example, when the absolute value of the difference between the set temperature and the current temperature is greater than the first upper limit reference value and less than the second upper limit reference value while the current temperature is disposed in the section exceeding the upper temperature limit, the compressor 21 cooling capacity may increase by the first level.

Alternatively, when the absolute value of the difference between the set temperature and the current temperature is greater than the second upper limit reference value and less than the third upper limit reference value while the current temperature is disposed in the section exceeding the upper temperature limit, the cooling capacity of the compressor 21 may increase by the second level.

In addition, when the absolute value of the difference between the set temperature and the current temperature is greater than or equal to the third upper limit reference value while the current temperature is disposed in a section exceeding the upper temperature limit, the cooling capacity of the compressor 21 may increase by a third level.

In the present embodiment, a difference value between the plurality of levels may be set to be the same or different.

For example, the first level may be set to a cooling capacity change value A, the second level may be set to a cooling capacity change value 2*A, and the third level may be set to a cooling capacity change value 3*A. Alternatively, the first level may be set to a cooling capacity change value of A, the second level may be set to a cooling capacity change value B (value greater than A) rather than 2*A, and the third level may be set to a cooling capacity change value C (value greater than B) rather than 3*A.

In addition, in the present embodiment, difference values between the plurality of upper limit reference values or the plurality of lower limit reference values may be set to be the same or different.

For example, the first upper limit reference value may be set to 0.5, the second upper limit reference value may be set to 1, and the third upper limit reference value may be set to 1.5. Alternatively, the first upper limit reference value may be set to 0.5, the second upper limit reference value may be set to 0.9, and the third upper limit reference value may be set to 1.3.

In a state in which the cooling capacity of the compressor 21 decrease (for example, cooling capacity decreases from 60 to 55), the current temperature may be sensed after the set time. Then, if the current temperature is disposed in the range exceeding the lower temperature limit (e.g., if the absolute value of the difference between the set temperature and the current temperature is greater than the first lower limit reference value and less than the second lower limit reference value), the cooling capacity of the compressor 21 may decrease again (for example, cooling capacity decreases from 55 to 50).

In addition, in the state in which the cooling capacity of the compressor 21 increases (for example, the cooling capacity increases from 45 to 50), the current temperature may be sensed after the set time. Then, if the current temperature is disposed in an upper temperature section (e.g., if the absolute value of the difference between the set temperature and the current temperature is greater than the second upper limit reference value and less than the third upper and lower reference value), the cooling capacity of the compressor may increase again (for example, cooling capacity increases from 50 to 60).

As described above, as the temperature of the storage space is sensed at each set time interval, and the cooling capacity of the cooling apparatus is adjusted, the temperature of the storage space converges to the set temperature as long as there is no influence of external factors.

Also, as described above, the set time may be determined every time the set time elapses.

As a first example, the set time may be changed in response to the absolute value of the difference between the set temperature and the current temperature.

Alternatively, as a second example, when the absolute value of the difference between the set temperature and the current temperature is greater than the first set value, the initial set time is selected, and when the absolute value of the difference between the set temperature and the current temperature is greater than the first set value and less than the second set time, a first set time shorter than the initial set time may be selected. When the absolute value of the difference between the set temperature and the current temperature is greater than the second set value, a second set time less than the first set time may be selected. FIG. 7 illustrates a second example as an example.

Figure 8:
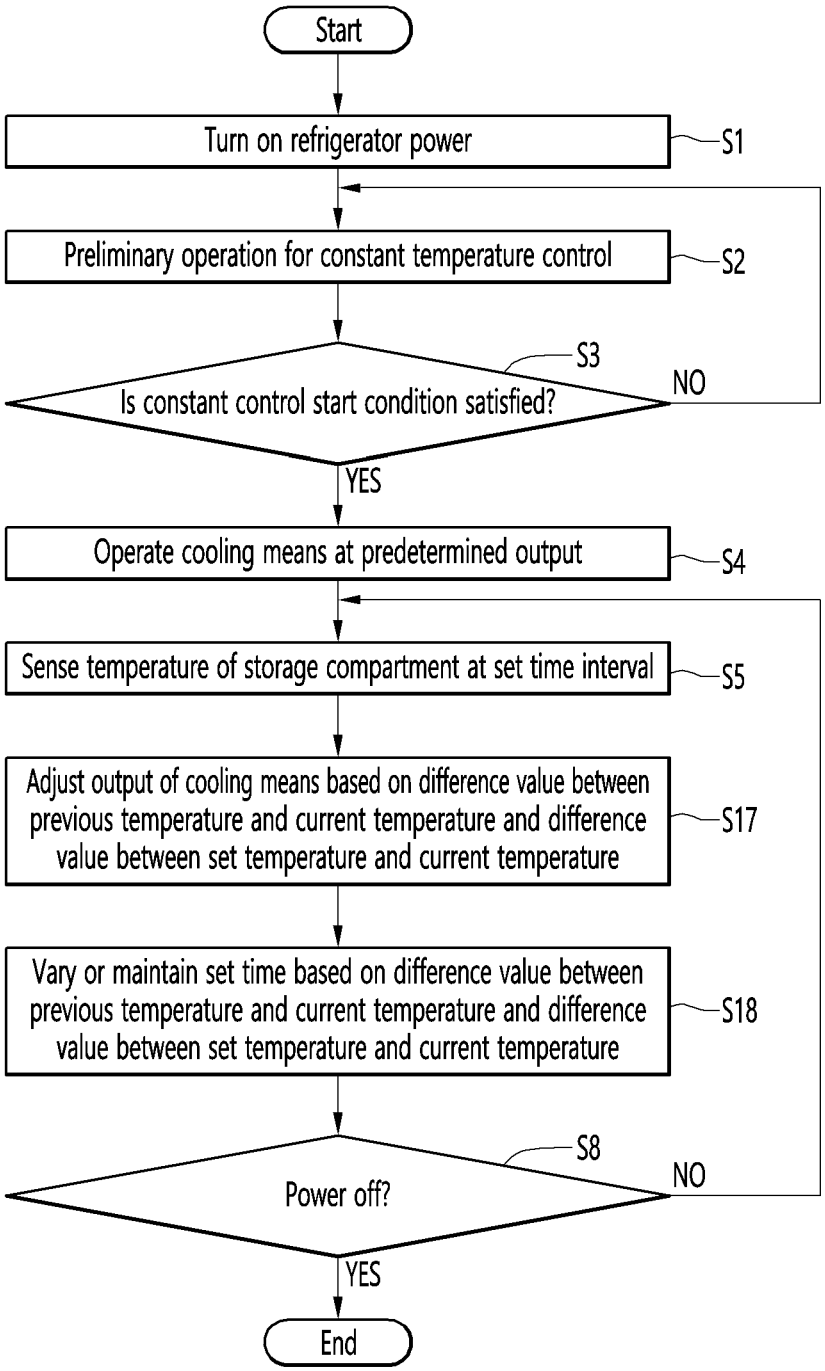
FIG. 8 is a flowchart illustrating a method for controlling a refrigerator according to a third embodiment of the present invention.
Figure 9:
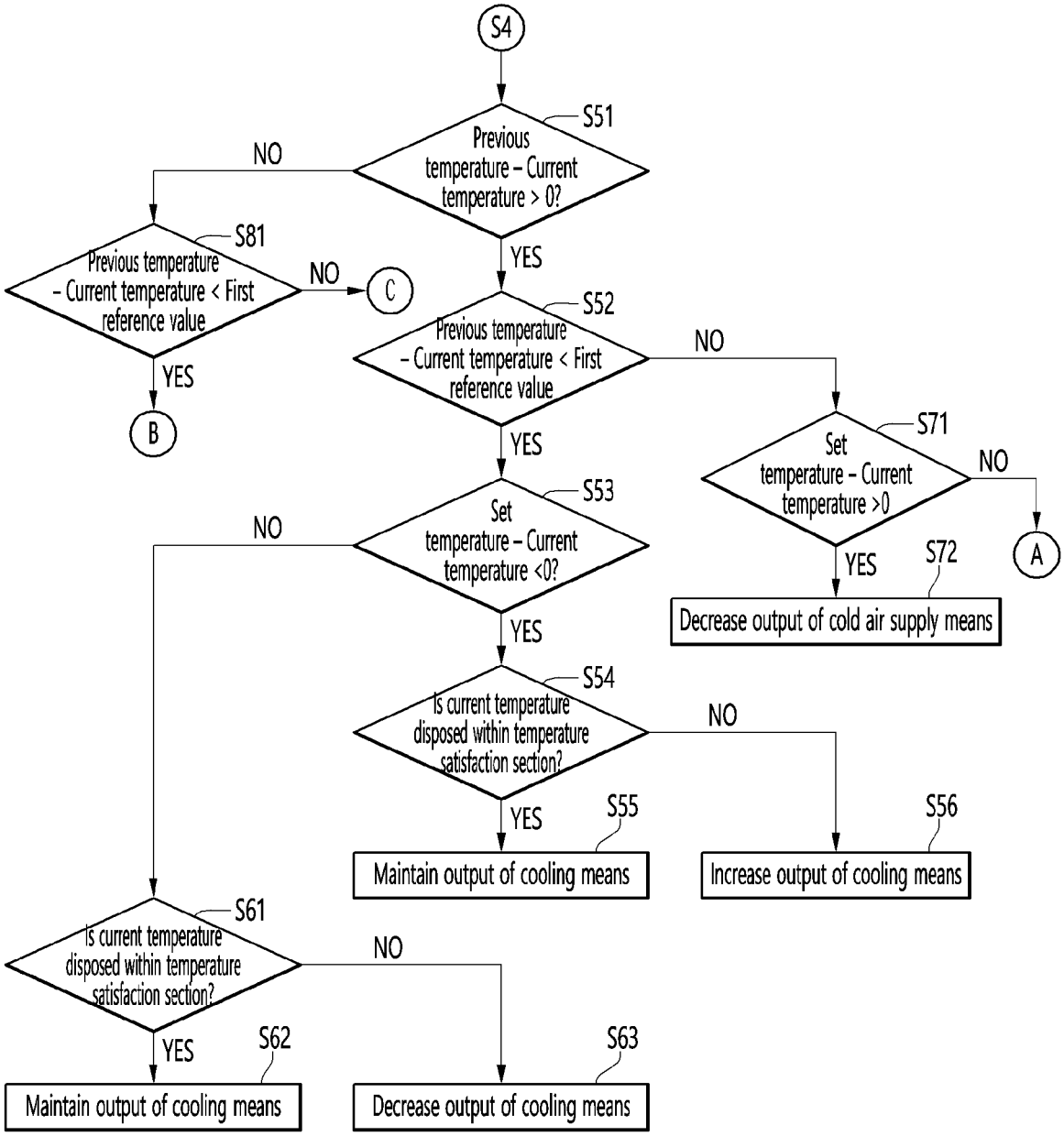
FIGS. 9 to 12 are flowchart for explaining a method for adjusting an output of a cooling apparatus according to a third embodiment.
Figure 10:
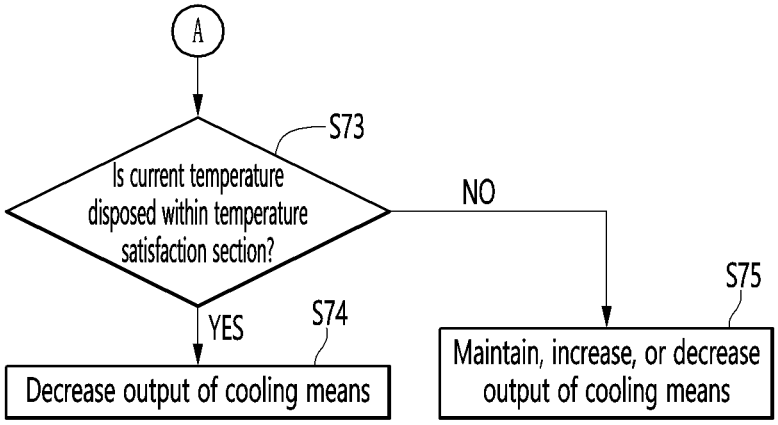
Figure 11:
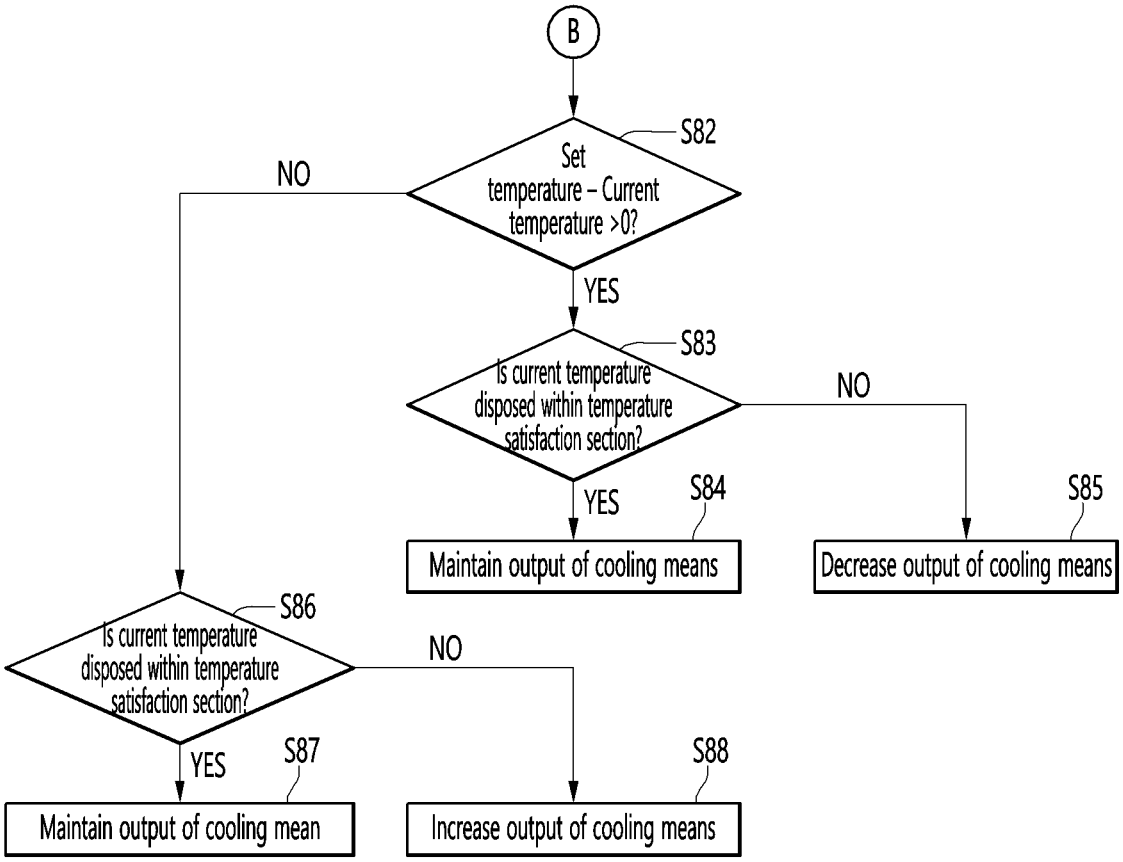
Figure 12:
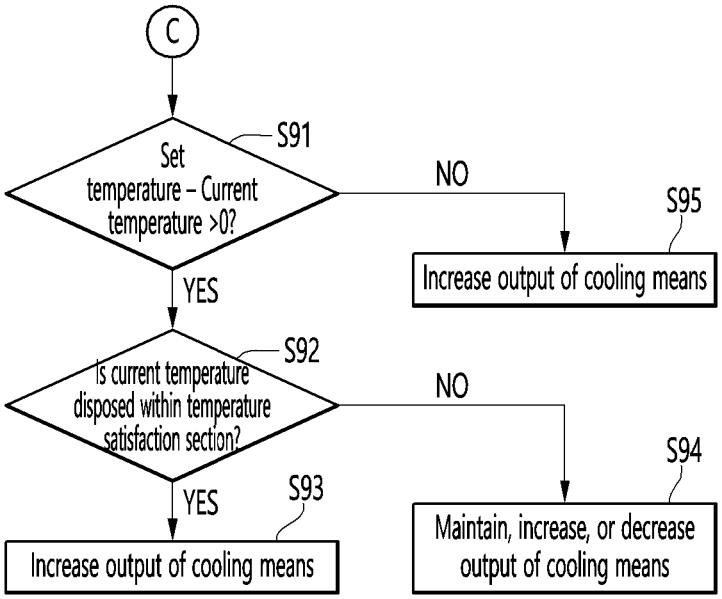

FIG. 8 is a flowchart illustrating a method for controlling a refrigerator according to a third embodiment of the present invention.

The present embodiment is the same as the previous embodiments in other portions, but is characterized in that the type of factors for controlling the refrigerator is different. Thus, only characterized portions in the present embodiment will be described below.

Referring to FIG. 8, operations S1 to S4 previously described in the first embodiment are equally applied to a control method according to the present embodiment.

That is, when a refrigerator is turned on, a preliminary operation is performed, and the cooling apparatus is stopped. Then, when it is determined that a constant temperature control start condition is satisfied, a control for temperature of a storage space is performed.

In this case, when the constant temperature control start condition is satisfied, a temperature of the storage space may reach a specific temperature within the temperature satisfaction section. For example, when the temperature of the storage space reaches a set temperature of the storage space, the cooling apparatus may operate.

In the present embodiment, the constant temperature control process may include a process of sensing the temperature of the storage space at a predetermined time intervals (S5) and a process of adjusting an output of a cooling apparatus (S16).

In the present embodiment, the controller 50 may adjust the output of the cooling apparatus to control the constant temperature of the storage space, but the controller 50 may adjust the output of the cooling apparatus based on the temperature of the storage space. For example, the controller 50 may adjust the output of the cooling apparatus so that the temperature of the storage space is maintained within the temperature satisfaction section.

The controller 50 adjusts the output of the cooling apparatus by using the change in temperature of the storage space described in the first embodiment and the difference between the set temperature described in the second embodiment and the current temperature of the storage space (S17).

Therefore, hereinafter, the terms used in the first embodiment and the terms used in the second embodiment are identically used.

In the present embodiment, the trend of the temperature change of the storage space uses a difference value between the previous temperature and the current temperature. The temperature change of the storage space is based on a temperature value of the storage space sensed at a set time interval.

According to the first factor (the difference between the previous temperature and the current temperature) and the second factor (the difference between the set temperature and the current temperature) for controlling the output of the cooling apparatus, the output of the cooling apparatus may decrease or be maintained in the current state.

For example, the controller 50 may determine whether the output of the cooling apparatus increases, is maintained, or decreases based on the first factor, and determine whether the output of the cooling apparatus increases, is maintained, or decreases based on the second factor, and then finally determine whether the output of the cooling apparatus increases, is maintained, or decreases by synthesizing the above factors.

For example, if it is determined to maintain the output of the cooling apparatus based on the first factor and it is determined to increase the output of the cooling apparatus based on the second factor, the output of the cooling apparatus finally increases.

If it is determined to maintain the output of the cooling apparatus based on the first factor and if it is determined to decrease the output of the cooling apparatus based on the second factor, the output of the cooling apparatus finally decreases.

When it is determined to maintain the output of the cooling apparatus as a result of each of the first factor and the second factor, the output of the cooling apparatus is finally maintained.

As a result based on the first factor, it is determined to increase the output of the cooling apparatus, and as a result based on the second factor, it is determined to maintain the output of the cooling apparatus, the output of the cooling apparatus finally increases.

When it is determined to reduce the output of the cooling apparatus based on the first factor and it is determined to maintain the output of the cooling apparatus based on the second factor, the output of the cooling apparatus finally decreases.

When it is determined to increase the output of the cooling apparatus as a result based on each of the first factor and the second factor, the output of the cooling apparatus finally increases.

When it is determined to decrease the output of the cooling apparatus as a result of each of the first factor and the second factor, the output of the cooling apparatus finally decreases.

When it is determined to decrease the output of the cooling apparatus based on the first factor, and it is determined to increase the output of the cooling apparatus based on the second factor, the output of the cooling apparatus may be maintained, increased, or decreased according to a magnitude of the decreasing output finally determined based on the first factor and a magnitude of the increasing output determined based the second factor.

When it is determined to increase the output of the cooling apparatus based on the first factor, and it is determined to decrease the output of the cooling apparatus based on the second factor, the output of the cooling apparatus may be maintained, increased, or decreased according to a magnitude of the increasing output finally determined based on the first factor and a magnitude of the decreasing output determined based the second factor.

After the output of the cooling apparatus is determined, the determined output is maintained for a set time, and when the set time elapses, the output of the cooling apparatus is determined again. That is, the output of the cooling apparatus may be adjusted for each set time interval. The controller controls the cooling apparatus to operate the cooling apparatus with the determined output during the set time.

The controller 50 may adjust the set time by using the transition of the temperature change of the storage space described in the first embodiment and the difference between the set temperature described in the second embodiment and the current temperature of the storage space (S18).

The temperature change of the storage space is based on a temperature value of the storage space sensed at a set time interval. Therefore, the set time is a sampling time for determining the trend of the temperature change.

At the beginning of the constant temperature control process, the temperature change of the storage space may be sensed at a predetermined set time interval. The initially used set time may be referred to as an initial set time. Although not limited, the initial set time may be maximum.

The set time ST may be determined by ST=a×(initial set time/$e_t$). Here, a is a value greater than 0 and less than 1, and $e_t$ is an absolute value of the difference between the previous temperature and the current temperature.

As another example, the set time ST may be determined by ST=a×(initial set time/$e_{t1}$). Here, a is a value greater than 0 and less than 1, and $e_{t1}$ is an absolute value of the difference between the set temperature and the current temperature.

As further another example, the set time ST may be determined by ST=a×(initial set time/($e_t$+$e_{t1}$)).

As further another example, a plurality of set times including the initial set time may be stored in the memory 52 in advance, and one of the plurality of set times may be selected based on the difference between the set temperature and the current temperature.

As further another example, a plurality of set times including the initial set time may be stored in the memory 52 in advance, and one of the plurality of set times may be selected based on the difference between the previous temperature and the current temperature.

As further another example, a plurality of set times including the initial set time may be stored in the memory 52 in advance, and one of the plurality of set times may be selected based on the difference between the set temperature and the current temperature and the difference between the previous temperature and the current temperature.

The difference value and the set time may be in inverse proportion to each other. As the difference value increases, the set time may be shortened.

That the set time decreases means that a period for which the output of the cooling apparatus is adjusted decreases, and in this case, it is possible to quickly respond to the temperature change in the storage space.

In summary, whenever the set time elapses, the output of the cooling capacity of the cooling apparatus may be determined, and the set time to be applied next time may be determined.

The controller 50 continues the constant temperature control unless the power of the refrigerator 1 is turned off (S8).

Hereinafter, a specific control method of adjusting the output of the cooling apparatus for constant temperature control will be described as an example.

FIGS. 9 to 12 are flowchart for explaining a method for adjusting an output of a cooling apparatus according to a third embodiment.

At a start time of a constant temperature control, an output of a cooling apparatus is set to a predetermined output between a minimum output and a maximum output (hereinafter, referred to as an "initial output").

Referring to FIGS. 9 to 12, a controller 50 may control the cooling apparatus to operate with an initial output for the constant temperature control in a state in which the current temperature of the storage space has reached a set temperature. For example, a compressor and a fan driving portion may operate with the initial output, and a damper 12 may be opened at an initial angle greater than zero.

When a set time elapses while the cooling apparatus operates with the initial output, temperature sensors 41 and 42 sense a temperature of a storage space.

Then, the controller 50 determines whether a difference between a previous temperature and a current temperature of the storage space sensed by the temperature sensors 41 and 42 is greater than 0 (S51). Here, at the beginning of the constant temperature control, the previous temperature will be the set temperature.

If the difference between the previous temperature and the current temperature is greater than 0, the temperature of the storage space may decrease.

As a result of the determination in operation S51, when the difference between the previous temperature and the current temperature is greater than 0, the controller 50 determines whether the difference between the previous temperature and the current temperature is less than a first reference value (S52).

As a result of the determination in operation S52, when the difference between the previous temperature and the current temperature is less than the first reference value, the controller 50 determines to maintain the output of the cooling apparatus as a result of determining a first factor.

Next, the controller 50 determines whether the difference between the set temperature and the current temperature is less than zero (S53).

If the difference between the set temperature and the current temperature is less than 0, the current temperature may be greater than the set temperature. If the difference between the set temperature and the current temperature is greater than 0, the current temperature and the set temperature may be the same, or the current temperature may be less than the set temperature.

As a result of the determination in operation S53, when the difference between the set temperature and the current temperature is less than 0, the controller 50 may determine whether the current temperature is disposed in a temperature satisfaction section (S54).

If the difference between the set temperature and the current temperature is less than a unit temperature, the current temperature may be close to the set temperature.

As a result of the determination in operation S54, when the current temperature is disposed in the temperature satisfaction section, the controller 50 may determine to maintain the output of the cooling apparatus as a result of determining a second factor.

Thus, the controller 50 may finally determine to maintain the current output of the cooling apparatus according to the results (S51 and S52) based on the first factor and the results (S53 and S54) based on the second factor (S55).

On the other hand, as the result of the determination in operation S54, if the current temperature is not disposed in the temperature satisfaction section (when it is disposed in a section exceeding the upper temperature limit), the controller 50 may determine that the output of the cooling apparatus increases as the result of determining the second factor.

Thus, the controller 50 may finally determine to increase the current output of the cooling apparatus according to the results (S51 and S52) based on the first factor and the results (S53 and S54) based on the second factor (S56).

Here, when the current temperature is disposed in the section exceeding the upper temperature limit, an absolute value of a difference between the set temperature and the current temperature may be compared with a plurality of upper limit reference values so that an output increase amount of the cooling apparatus is different.

For example, as described in the second embodiment, when the absolute value of the difference between the set temperature and the current temperature is greater than the first upper limit reference value and less than the second upper limit reference value while the current temperature is disposed in the section exceeding the upper temperature limit, the output of the cooling apparatus may increase by the first level.

Alternatively, when the absolute value of the difference between the set temperature and the current temperature is greater than the second upper limit reference value and less than the third upper limit reference value while the current temperature is disposed in the section exceeding the upper temperature limit, the output of the cooling apparatus may increase by a second level.

In addition, when the absolute value of the difference between the set temperature and the current temperature is greater than or equal to the third upper limit reference value while the current temperature is disposed in a section exceeding the upper temperature limit, the output of the cooling apparatus may increase by a third level.

On the other hand, as a result of the determination in operation S53, when the difference between the set temperature and the current temperature is greater than 0, the controller 50 may determine whether the current temperature is disposed in a temperature satisfaction section (S61).

As a result of the determination in operation S61, when the current temperature is disposed in the temperature satisfaction section, the controller 50 may determine to maintain the output of the cooling apparatus as a result of determining a second factor.

Thus, the controller 50 may finally determine to maintain the current output of the cooling apparatus according to the results (S51 and S52) based on the first factor and the results (S53 and S61) based on the second factor (S62).

On the other hand, as the result of the determination in operation S61, if the current temperature is not disposed in the temperature satisfaction section (when the current temperature is disposed in a section exceeding the lower temperature limit), the controller 50 may determine that the output of the cooling apparatus decreases as the result of determining the second factor.

Thus, the controller 50 may finally determine to decrease the current output of the cooling apparatus according to the results (S51 and S52) based on the first factor and the results (S53 and S61) based on the second factor (S55).

Here, when the current temperature is disposed in the section exceeding the lower temperature limit, an absolute value of a difference between the set temperature and the current temperature may be compared with a plurality of lower limit reference values so that an output decrease amount of the cooling apparatus is different.

For example, as described in the second embodiment, when the absolute value of the difference between the set temperature and the current temperature is greater than the first lower limit reference value and less than the second lower limit reference value while the current temperature is disposed in the section exceeding the lower temperature limit, the output of the cooling apparatus may increase by the first level.

Alternatively, when the absolute value of the difference between the set temperature and the current temperature is greater than the second lower limit reference value and less than the third lower limit reference value while the current temperature is disposed in the section exceeding the upper temperature limit, the output of the cooling apparatus may decrease by a second level.

In addition, when the absolute value of the difference between the set temperature and the current temperature is greater than or equal to the third lower limit reference value while the current temperature is disposed in a section exceeding the lower temperature limit, the output of the cooling apparatus may decrease by a third level.

As the result of the determination in operation S52, when it is determined that the difference between the previous temperature and the current temperature is equal to or greater than the first reference value, the controller 50 may determine to decrease the output of the cooling apparatus as the result of determining the first factor.

Next, the controller 50 may determine whether the difference between the set temperature and the current temperature is greater than 0 (S71).

As the result of the determination in operation S71, when the difference between the set temperature and the current temperature is greater than 0, the controller 50 may determine to maintain or decrease the output of the cooling apparatus according to a magnitude of the difference between the set temperature and the current temperature (according to whether the current temperature is disposed in the temperature satisfaction section) as the result of determining the second factor.

Here, when the current temperature is disposed in the temperature satisfaction section, it may be determined that the output of the cooling apparatus is maintained, and when the current temperature is not disposed in the temperature satisfaction section (the current temperature is disposed in the section exceeding the lower temperature limit), a decrease level of the output of the cooling apparatus may be determined according to the absolute value of the difference between the set temperature and the current temperature.

In any case, the controller 50 may finally determine to decrease the current output of the cooling apparatus according to the results (S51 and S52) based on the first factor and the results (S71) based on the second factor (S72).

On the other hand, as a result of the determination in operation S71, when the difference between the set temperature and the current temperature is less than 0, the controller 50 may determine whether the current temperature is disposed in a temperature satisfaction section (S73).

As a result of the determination in operation S73, when the current temperature is disposed in the temperature satisfaction section, the controller 50 may determine to maintain the output of the cooling apparatus as a result of determining a second factor.

Thus, the controller 50 may finally determine to decrease the current output of the cooling apparatus according to the results (S51 and S52) based on the first factor and the results (S71 and S73) based on the second factor (S74).

On the other hand, if the current temperature is not disposed in the temperature satisfaction section (when the current temperature is disposed in a section exceeding the upper temperature limit), the controller 50 may determine that the output of the cooling apparatus increases as the result of determining the second factor.

In this case, the controller 50 may determine to maintain, increase, or decrease the output of the cooling apparatus according to the results (S51 and S52) based on the first factor and the results (S71 and S73) based on the second factor (S75).

For example, whether to maintain, increase, or decrease the output of the cooling apparatus may be determined according to the magnitude of the output of the cooling apparatus that decreases as the result of the first factor and the output of the cooling apparatus that increases as the result of the second factor.

That is, when the output of the cooling apparatus which decreases as the result of the first factor and the output of the cooling apparatus which increases as the result of the second factor are the same, the controller 50 may finally determine to maintain the output of the cooling apparatus.

Alternatively, when the output of the cooling apparatus which decreases as the result of the first factor is greater than the output of the cooling apparatus which increases as the result of the second factor, the controller 50 may finally determine to decrease the output of the cooling apparatus.

Alternatively, when the output of the cooling apparatus which decreases as the result of the first factor is less than the output of the cooling apparatus which increases as the result of the second factor, the controller 50 may finally determine to increase the output of the cooling apparatus.

As a result of the determination in operation S51, when the difference between the previous temperature and the current temperature is equal to or less than 0, the controller 50 determines whether the difference between the previous temperature and the current temperature is less than a first reference value (S81).

Here, the case in which the difference between the previous temperature and the current temperature is equal to or less than 0 is a case in which the temperature of the storage space is maintained for the sampling time, or the temperature rises.

As a result of the determination in operation S81, when the difference between the previous temperature and the current temperature is less than the first reference value, the controller 50 may determine to maintain the output of the cooling apparatus as the result of determining the first factor.

The controller 50 determines whether the difference between the set temperature and the current temperature is greater than zero (S82).

As a result of the determination in operation S82, when the difference between the set temperature and the current temperature is greater than 0, whether the current temperature is disposed in a temperature satisfaction section is determined (S83).

As a result of the determination in operation S83, when the current temperature is disposed in the temperature satisfaction section, the controller 50 may determine to maintain the output of the cooling apparatus as a result of determining a second factor.

Thus, the controller 50 may finally determine to maintain the current output of the cooling apparatus according to the results (S51 and S81) based on the first factor and the results (S82 and S83) based on the second factor (S84).

On the other hand, as the result of the determination in operation S83, if the current temperature is not disposed in the temperature satisfaction section (when the current temperature is disposed in a section exceeding the lower temperature limit), the controller 50 may determine that the output of the cooling apparatus decreases as the result of determining the second factor.

Thus, the controller 50 may finally determine to decrease the current output of the cooling apparatus according to the results (S51 and S81) based on the first factor and the results (S82 and S83) based on the second factor (S85).

As a result of the determination in operation S82, when the difference between the set temperature and the current temperature is less than 0, the controller 50 may determine whether the current, temperature is disposed in a temperature satisfaction section (S86).

As a result of the determination in operation S86, when the current temperature is disposed in the temperature satisfaction section, the controller 50 may determine to maintain the output of the cooling apparatus as a result of determining a second factor.

Thus, the controller 50 may finally determine to maintain the current output of the cooling apparatus according to the results (S51 and S81) based on the first factor and the results (S82 and S86) based on the second factor (S85).

On the other hand, as the result of the determination in operation S86, if the current temperature is not disposed in the temperature satisfaction section (when the current temperature is disposed in a section exceeding the upper temperature limit), the controller 50 may determine an output increase level of the cooling apparatus may be determined according to a comparison between the absolute value of the difference between the set temperature and the current temperature and the plurality of reference values as the result of determining the second factor.

Thus, the controller 50 may finally determine to increase the current output of the cooling apparatus according to the results (S51 and S81) based on the first factor and the results (S82 and S86) based on the second factor (S88).

As the result of the determination in operation S81, when it is determined that the difference between the previous temperature and the current temperature is equal to or greater than the first reference value, the controller 50 may determine to increase the output of the cooling apparatus as the result of determining the first factor.

The controller 50 may determine whether the difference between the set temperature and the current temperature is greater than 0 (S91).

As a result of the determination in operation S91, when the difference between the set temperature and the current temperature is greater than 0, the controller 50 may determine whether the current temperature is disposed in a temperature satisfaction section (S92).

As a result of the determination in operation S92, when the current temperature is disposed in the temperature satisfaction section, the controller 50 may determine to maintain the output of the cooling apparatus as the result of determining the second factor.

Thus, the controller 50 may finally determine to increase the current output of the cooling apparatus according to the results (S51 and S81) based on the first factor and the results (S91 and S92) based on the second factor (S93).

On the other hand, if the current temperature is not disposed in the temperature satisfaction section (when the current temperature is disposed in a section exceeding the lower temperature limit), the controller 50 may determine that the output of the cooling apparatus decreases as the result of the determination of the second factor.

In this case, the controller 50 may determine to maintain, increase, or decrease the output of the cooling apparatus according to the results (S51 and S81) based on the first factor and the results (S91 and S92) based on the second factor (S94).

For example, whether to maintain, increase, or decrease the output of the cooling apparatus may be determined according to the magnitude of the output of the cooling apparatus that increases as the result of the first factor and the output of the cooling apparatus that decreases as the result of the second factor.

That is, when the output of the cooling apparatus which increases as the result of the first factor and the output of the cooling apparatus which decreases as the result of the second factor are the same, the controller 50 may finally determine to maintain the output of the cooling apparatus.

Alternatively, when the output of the cooling apparatus which increases as the result of the first factor is greater than the output of the cooling apparatus which decreases as the result of the second factor, the controller 50 may finally determine to increase the output of the cooling apparatus.

Alternatively, when the output of the cooling apparatus which increases as the result of the first factor is less than the output of the cooling apparatus which decreases as the result of the second factor, the controller 50 may finally determine to decrease the output of the cooling apparatus.

As the result of the determination in operation S91, when the difference between the set temperature and the current temperature is equal to or less than 0, the controller 50 may determine to maintain or increase the output of the cooling apparatus according to the absolute value of the difference between the set temperature and the current temperature as the result of determining the second factor.

Here, when the absolute value of the difference between the set temperature and the current temperature is less than the first reference value, it may be determined that the output of the cooling apparatus is maintained.

When the absolute value of the difference between the set temperature and the current temperature is equal to or greater than the first reference value, an output increase level of the cooling apparatus may be determined according to a comparison between the absolute value of the difference between the set temperature and the current temperature and the plurality of reference values.

In any case, the controller 50 may finally determine to decrease the current output of the cooling apparatus according to the results based on the first factor (S51 and S52) and the results based on the second factor (S91) (S95).

Figure 13:
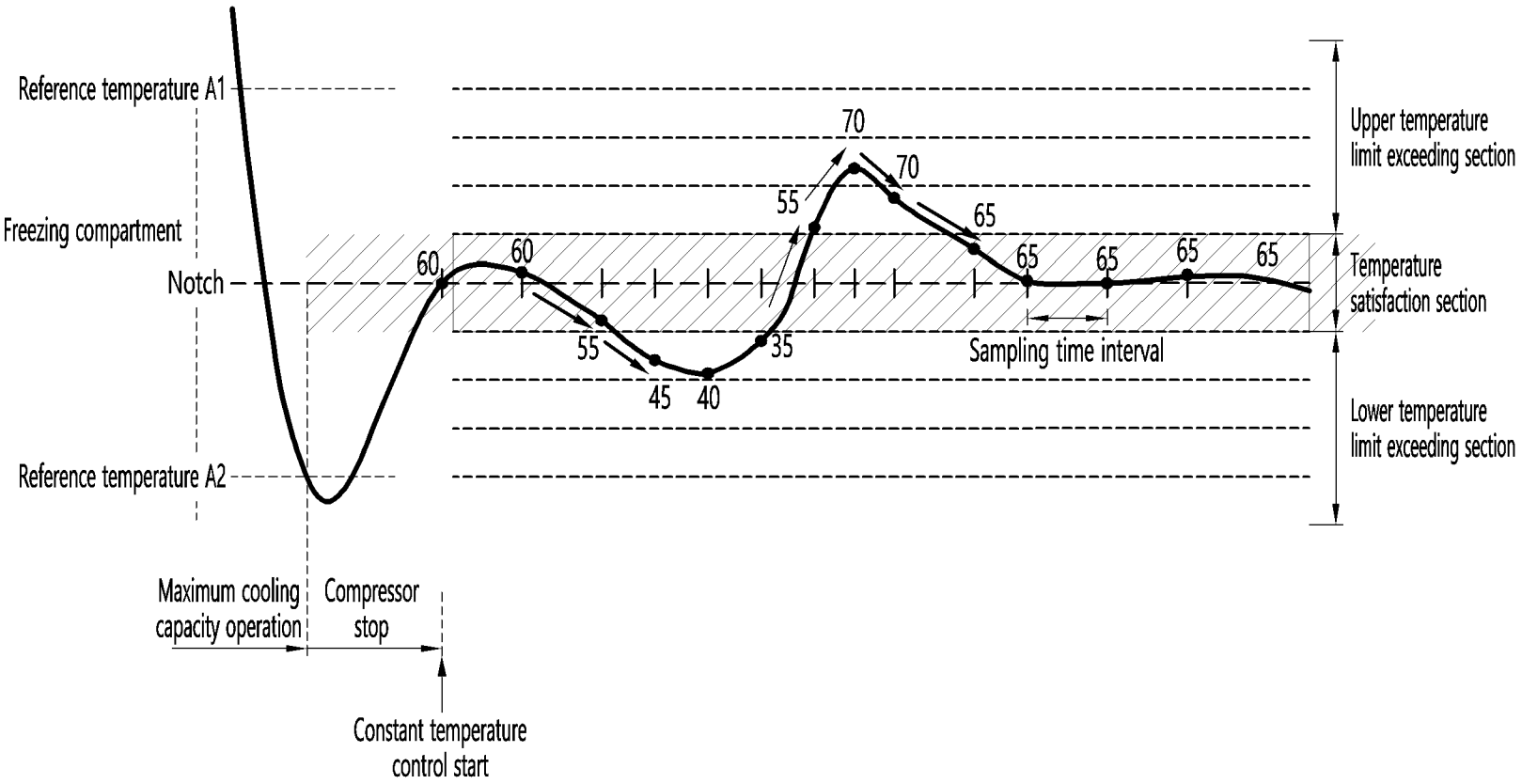
FIG. 13 is a graph for explaining a temperature change of a storage space and an output control of a cooling apparatus according to the third embodiment.

FIG. 13 is a graph for explaining a temperature change of the storage space and the output control of the cooling apparatus according to the third embodiment.

For example, FIG. 13 illustrates a change in cooling capacity of the compressor for maintaining the freezing compartment at a constant temperature and a corresponding change in temperature of the freezing compartment, and the numbers in the graph are examples of the cooling capacity of the compressor.

Referring to FIG. 13, after power of the refrigerator is turned on, or a defrosting operation is completed, the compressor 21 may operate at a maximum cooling capacity to quickly lower the temperature of the freezing compartment. When the temperature of the freezing compartment reaches the off-reference temperature A2, the compressor 21 is stopped.

When the compressor 21 is stopped, the temperature of the freezing compartment rises, and when the temperature of the freezing compartment reaches a set temperature (notch), the control for the constant temperature of the freezing compartment may start.

As described above, the temperature of the freezing compartment is sensed at the set time interval, and the controller 50 may adjust the cooling capacity of the compressor 21 based on the first factor and the second factor.

Although not limited, the cooling capacity of the compressor 21 may be determined by $MV_t=MV_{t-1}-(K_p(e_t-e_{t-1})+K_i(e_t))$.

Where $MV_t$ is the current cooling capacity of the cooling apparatus, $MV_{t-1}$ is the previous cooling capacity of the cooling apparatus, $K_p$ is a P control gain value, $e_t$ is a difference between the set temperature and the current temperature, $e_{t-1}$ is a difference between the set temperature and the previous temperature, $K_i$ is an I control gain value, and $e_t$ is a difference between the set temperature and the current temperature.

In the case of an embodiment, $K_p$ and $K_i$ may be fixed values as gain values. Alternatively, one or more of $K_p$ and $K_i$ may vary based on the difference between the set temperature and the current temperature.

For example, if the absolute value of the difference between the previous temperature and the current temperature is high, $K_p$ may increase, and if the absolute value of the difference between the previous temperature and the current temperature is low, $K_p$ may decrease.

Alternatively, if the absolute value of the difference between the set temperature and the current temperature is high, $K_i$ may increase, and if the absolute value of the difference between the set temperature and the current temperature is low, $K_i$ may decrease.

Alternatively, one or more of $K_p$ and $K_i$ may increase or decrease based on the values considering the first factor and the second factor.

While the compressor 21 operates at a cooling capacity of 60, the cooling capacity may be maintained (cooling capacity: 60), decrease (cooling capacity: 55, 45, 40, and 35), or increase (cooling capacity: 70 and 65) according to the temperature of the freezing compartment.

Here, when a refrigerator door is opened to increase in temperature of the storage space, or when food is additionally introduced into the storage space, if the storage space is overheated, and thus the temperature of the storage space is equal to or greater than an on-reference temperature A1, the controller 50 may control the cooling apparatus to operate at a predetermined first output value, for example, a maximum output so that the temperature of the storage space rapidly decreases.

For example, the controller 50 may sense whether the door of the refrigerator is opened, and when the temperature of the storage space is equal to or greater than the reference temperature A1 after the door opening is sensed, the controller 50 may control the cooling apparatus to operate at the predetermined first output value, for example, the maximum output so that the temperature of the storage space reaches an off-reference temperature A2 during the sampling time, or until the temperature of the storage space reaches a specific temperature within the temperature satisfaction section or until the temperature of the storage space reaches the off-reference temperature A2. Then, the controller 50 may stop the cooling apparatus. The controller 50 may allow the cooling apparatus to operate at a second output value less than the first output value when the temperature of the storage space reaches the set temperature.

As described above, the set time may be determined every time the set time elapses.

As a first example, the set time may be changed based on a result of considering the first factor and the second factor.

Alternatively, as a second example, the set time may be changed according to the change in cooling capacity determined in consideration of the first factor and the second factor. For example, when the cooling capacity change value is large, the set time may decrease, and when the cooling capacity change value is small, the set time period may increase.

When the cooling capacity is maintained, the set time may be maintained without being changed. When the cooling capacity varies by a first level, a first set time less than an initial set time may be selected. When the cooling capacity varies by the second level, a second set time less than the first set time may be selected. FIG. 13 illustrates a second example as an example.

As described above, as the temperature of the storage space is sensed at each set time interval, and the cooling capacity of the cooling apparatus is adjusted, the temperature of the storage space converges to the set temperature as long as there is no influence of external factors.

As described above, in order to maintain the temperature of the storage space in a state of being close to the set temperature, the output of the cooling apparatus may be maintained at a specific output through an output control process.

According to the proposed embodiment, since the temperature of the storage space is constantly maintained, a storage period of food may increase. That is, a phenomenon in which the foods stored in the storage room are overcooled or withered may be removed.

In addition, since the cooling apparatus is not stopped, but maintained in a driving state (continuous operation) in order to constantly maintain the temperature of the storage space, there is an effect of reducing power consumption according to the initial driving of the cooling apparatus.

In addition, since the output of the cooling apparatus is adjusted based on the difference between the previous temperature and the current temperature and the difference between the set temperature and the current temperature, there is an advantage in that, when the temperature of the storage space is out of the constant temperature state, the temperature is quickly restored to the constant temperature state.

In addition, as the set time is adjusted, there is an advantage in that the temperature of the storage space is quickly restored within the temperature satisfaction section even when a range of temperature change in the storage space is large.

In common in the above embodiments, when the temperature of the storage space is equal to or greater than the reference temperature A1, the temperature of the storage space has to quickly decrease, and when the temperature of the storage space is equal to or less than the reference temperature A2, the temperature of the storage space has to quickly increase.

Therefore, while the constant temperature control is performed, when the temperature of the storage space is equal to or greater than the reference temperature A1 or equal to or less than the reference temperature A2 (when a constant temperature control termination condition is satisfied), the constant temperature control may be terminated, and a normal temperature control may be performed.

The case in which the temperature of the storage space is equal to or greater than the reference temperature A1 during the constant temperature control may be, for example, a case in which the door is opened to increase in temperature of the storage space, a case in which the door is opened, and high-temperature food is introduced, and a case in which the temperature of the storage space increase during defrosting. If a start condition of the constant temperature control is satisfied while the normal control is being performed after the constant temperature control is terminated, the constant temperature control may be performed again.

A case in which the temperature of the storage space is equal to or less than the reference temperature A2 during the constant temperature control may be, for example, a case in which cold air having a temperature less than the temperature of the storage space is supplied to the storage space. If a start condition of the constant temperature control is satisfied while the normal control is being performed after the constant temperature control is terminated, the constant temperature control may be performed again.

Alternatively, if defrosting is required during the constant temperature control, the constant temperature control may be terminated, and the general control may be performed in order to quickly decrease in the temperature of the storage space before the defrosting (when the constant temperature control termination condition is satisfied). Since the temperature of the storage space increases after the defrosting, the normal control may be performed after the defrosting, and the constant temperature control may be performed again if the constant temperature control start condition is satisfied during the normal operation.

In addition, in common in the above embodiments, the set temperature may be variable. The set temperature may be a target temperature of the storage space and may vary by a user.

The set temperature may be divided into strong, medium, and weak. If the set temperature is changed from the medium or weak to the strong during the constant temperature control, the constant temperature control may be terminated, and the normal control may be performed (when the constant temperature control termination condition is satisfied).

Alternatively, when the set temperature is weak, the set time may do not vary during the constant temperature control, and when the set temperature is changed to the strong, the set time may vary during the constant temperature control.

Alternatively, the set time may be fixed during the constant temperature control regardless of the set temperature. However, when the set temperature is weak, the set time may be determined as the first set time (for example, the initial set time) in the constant temperature control process, and when the set temperature is strong, the set time may be determined as a second set time less than the first set time.

Alternatively, when the set temperature is weak, a variable range of the set time determined based on the temperature change of the storage space during the constant temperature control may be small, and when the set temperature is changed to strong, the variable range of the set time determined based on the temperature change of the storage space during the constant temperature control may be large.

Alternatively, when the set temperature is weak, the control gain value may do not vary during the constant temperature control, and when the set temperature is changed to the strong, the control gain value may vary during the constant temperature control.

Alternatively, the control gain value may be fixed during the constant temperature control regardless of the set temperature. However, when the set temperature is weak, the control gain value may be determined as a first control gain value in the constant temperature control process, and when the set temperature is strong, the control gain value may be determined as a second control gain value greater than the first control gain value.

Alternatively, when the set temperature is weak, the variable range of the control gain value determined based on the temperature change of the storage space during the constant temperature control may be small, and when the set temperature is strong, the variable range of the set time determined based on the temperature change of the storage space during the constant temperature control.

Alternatively, if the set temperature is set to be less than a limit temperature during the constant temperature control, the constant temperature control may be terminated, and the general control may be performed (when the constant temperature control termination condition is satisfied).

Alternatively, during the constant temperature control, if the set temperature is set to be greater than the limit temperature, the set time may not be variable, and if the set temperature is set to be less than the limit temperature, the set time may be variable.

Alternatively, the set time may be fixed during the constant temperature control regardless of the set temperature. However, when the set temperature is set to be equal to or greater than the limit temperature, the set time may be determined as the first set time (for example, the initial set time) in the constant temperature control process, and when the set temperature is set to be less than the limit temperature, the set time may be determined as a second set time less than the first set time.

Alternatively, when the set temperature is set to be greater than the limit temperature, a variable range of the set time determined based on the temperature change of the storage space during the constant temperature control may be small, and when the set temperature is set to be less than the limit temperature, the variable range of the set time determined based on the temperature change of the storage space during the constant temperature control may be large.

Alternatively, when the set temperature is set to be greater than the limit temperature, the control gain value is not varied during the constant temperature control, and when the set temperature is set to be less than the limit temperature, the control gain value is varied during the constant temperature control.

Alternatively, the control gain value may be fixed during the constant temperature control regardless of the set temperature. However, when the set temperature is set to be equal to or greater than the limit temperature, the control gain value may be determined as the first control gain value in the constant temperature control process, and when the set temperature is set to be less than the limit temperature, the control gain value may be determined as a second control gain value greater than the first control gain value.

Alternatively, when the set temperature is set to be equal to or greater than the limit temperature, the variable range of the control gain value determined based on the temperature change of the storage space during the constant temperature control may be small, and when the set temperature is set to less than the limit temperature, the variable range of the set time determined based on the temperature change of the storage space during the constant temperature control.

As another example, when the change amount of the set temperature is less than the reference change amount, the set time may not vary during the constant temperature control, and when the change amount of the set temperature is equal to or greater than the reference change amount, the set time period may vary during the constant temperature control.

Alternatively, the set time may be fixed during the constant temperature control regardless of the set temperature. However, when the change amount of the set temperature is less than the reference change amount, the set time may be determined as the first set time (for example, the initial set time) in the constant temperature control process, and when the change amount of the set temperature is equal to or greater than the reference change amount, the set time may be determined as a second set time less than the first set time.

Alternatively, when the change amount of the set temperature is less than the reference change amount, the variable range of the set time determined based on the temperature change of the storage space during the constant temperature control is small, and when the change amount of the set temperature is equal to or greater than the reference change amount, the variable range of the set time determined based on the temperature change of the storage space during the constant temperature control may be large.

Alternatively, when the change amount of the set temperature is less than the reference change amount, the control gain value may not vary during the constant temperature control, and when the change amount of the set temperature is equal to or greater than the reference change amount, the control gain value may vary during the constant temperature control.

Alternatively, the control gain value may be fixed during the constant temperature control regardless of the set temperature. However, when the change amount of the set temperature is less than the reference change amount, the control gain value may be determined as the first control gain value in the constant temperature control process, and when the change amount of the set temperature is equal to or greater than the reference change amount, the control gain value may be determined as a second control gain value greater than the gain value.

Alternatively, when the change amount of the set temperature is less than the reference change amount, the variable range of the control gain value determined based on the temperature change of the storage space during the constant temperature control is small, and when the change amount of the set temperature is equal to or greater than the reference change amount, the variable range of the set time determined based on the temperature change of the storage space during the constant temperature control may be large.

As another example, the temperature outside the refrigerator may be divided into a plurality of regions. The plurality of regions may be divided into hot zones, intermediate zones, and cold zones.

When the external temperature is within the intermediate range, the constant temperature control may be performed. On the other hand, when the external temperature is a high temperature region or a low temperature region, the general control may be performed.

The invention claimed is:

1. A refrigerator comprising:

a cabinet providing a storage space;

a cooler configured to cool the storage space;

a temperature sensor configured to sense a temperature of the storage space at a set time interval; and a controller configured to control the cooler, wherein:

the controller is configured to adjust an output of the cooler based on at least one of a first value that is a difference between a previous temperature of the storage space and a current temperature of the storage space, and a second value that is a difference value-between a set temperature and the current temperature of the storage space, and the controller is configured to adjust the set time interval based on at least one of the first value or the second value.

2. The refrigerator of claim 1, wherein, when an absolute value of at least one of the first value or the second value increases, the controller decreases the set time interval.

3. The refrigerator of claim 2, wherein the controller determines the set time interval based on an equation of:

$$a\times(\text{initial } set \text{ time interval}/e_{t1}),$$

and wherein:

a is a value that is greater than 0 and less than 1, and $e_{t1}$ is the absolute value of the at least one of the first value or the second value.

4. The refrigerator of claim 2, wherein the controller selects the set time interval from a plurality of predetermined set times is based on the absolute value of the at least one of the first value or the second value.

5. The refrigerator of claim 4, wherein, when the absolute value of the at least one of the first value or the second value is less than a first set value, the controller selects an initial set time, when the absolute value of the at least one of the first value of the second value is greater than the first set value and less than a second set value, the controller selects a first set time that is less than the initial set time, and when the absolute value of the at least one of the first value or the second value is greater than the second set value, the controlled selects a second set time that is less than the first set time.

6. The refrigerator of claim 1, wherein the controller determines the output of the cooler based on an equation:

$$MV_t = MV_{t-1} - K_p(e_t - e_{t-1}),$$

and wherein:

$MV_t$ is a current output of the cooler, $MV_{t-1}$ is a previous output of the cooler, $K_p$ is a P control gain value, $e_t$ is the second value that is the difference between the set temperature and the current temperature, $e_{t-1}$ is a difference between the set temperature and the previous temperature, and $K_p$ is a variable that is determined based on the first value.

7. The refrigerator of claim 6, wherein, when an absolute value of the first value is greater than a set value, $K_p$ increases, and when an absolute of the first value is less than the set value, $K_p$ decreases.

8. The refrigerator of claim 1, wherein the controller determines the output of the cooler based on an equation:

$$MV_t = MV_{t-1} - K_i(e_t),$$

and wherein:

$MV_t$ is a current output of the cooler, $MV_{t-1}$ is a previous output of the cooler, $K_i$ is an I control gain value, $e_t$ is the second value that is the difference between the set temperature and the current temperature, and $K_i$ is a variable that is determined based on the second value.

9. The refrigerator of claim 8, wherein, when an absolute value of the second value is greater than a set value, $K_i$ increases, and when an absolute of the second value is less than the set value, $K_i$ decreases.

10. A refrigerator comprising:

a cabinet having a storage space;

a cooler configured to cool the storage space;

a temperature sensor configured to sense a temperature of the storage space at a set time interval; and a controller configured to control the cooler, wherein the controller is configured to adjust a cooling capacity of the cooler based on a difference value-between a previous temperature of the storage space and a current temperature of the storage space, wherein the cooling capacity of the cooler is determined by an equation of:

$$MV_t = MV_{t-1} - K_p(e_t - e_{t-1}),$$

and wherein:

$MV_t$ is a current cooling capacity of the cooler, $MV_{t-1}$ is a previous cooling capacity of the cooler, $K_p$ is a P control gain value, $e_t$ is a difference between a set temperature and the current temperature, $e_{t-1}$ is a difference between the set temperature and the previous temperature, and $K_p$ is a variable that is determined based on the difference value-between the previous temperature of the storage space and the current temperature of the storage space.

11. The refrigerator of claim 10, wherein:

when the difference between the previous temperature of the storage space and the current temperature of the storage space is greater than a set value, $K_p$ increases, and when the difference value-between the previous temperature of the storage space and the current temperature of the storage space is less than the set values, $K_p$ decreases.

12. A refrigerator comprising:

a cabinet providing a storage space;

a cooler configured to cool the storage space;

a temperature sensor configured to sense a temperature of the storage space at a set time interval; and a controller configured to control the cooler, wherein the controller is configured to adjust a cooling capacity of the cooler based on a difference value-between a set temperature and a current temperature of the storage space, wherein the cooling capacity of the cooler is determined by $$MV_t = MV_{t-1} - K_i(e_t),$$

wherein:

$MV_t$ is a current cooling capacity of the cooler, $MV_{t-1}$ is a previous cooling capacity of the cooler, $K_i$ is an I control gain value, $e_t$ is a difference between the set temperature and the current temperature, and $K_i$ is a variable that is determined based on the difference between the set temperature and the current temperature of the storage space.

13. The refrigerator of claim 12, wherein, when the difference between the set temperature and the current temperature of the storage space is greater than a set value, $K_i$ increases, and when the difference between the set temperature and the current temperature of the storage space is less than the set value, $K_i$ decreases.

14. A refrigerator comprising:

a cabinet with providing a storage space;

a cooler configured to cool the storage space;

a temperature sensor configured to sense a temperature of the storage space at a set time interval; and a controller configured to control the cooler, wherein:

the controller is configured to perform a constant temperature control or a normal control, during the constant temperature control, the controller is configured to adjust an output of the cooler based on one or more of a first value that is a difference between a previous temperature of the storage space and a current temperature of the storage space or a second value that is a difference between a set temperature and the current temperature of the storage space, when the controller is performing the constant temperature control, when a constant temperature control termination condition is satisfied, the controller switches to performing the normal control, and during the constant temperature control, the set time interval is variable, and during the normal control, the set time interval is fixed.

15. The refrigerator of claim 14, wherein, when the controller is performing the normal control, when a constant temperature control start condition is satisfied, the controller switches to performing the constant temperature control.

16. The refrigerator of claim 14, wherein the controller is configured to vary the set time interval based on one or more of the first value or the second value.

17. A refrigerator comprising:

a cabinet providing a storage space;

a cooler configured to cool the storage space;

a temperature sensor configured to sense a temperature of the storage space at a set time interval; and a controller configured to control the cooler, wherein;

the controller is configured to adjust an output of the cooler based on one or more of a first value that is a difference between a previous temperature of the storage space and a current temperature of the storage space or a second value that is a difference between a set temperature and the current temperature of the storage space, and the controller is configured to control the cooler so that the set time interval when the set temperature is less than a limit temperature differs from the set time interval when the set temperature is equal to or greater than the limit temperature.

18. The refrigerator of claim 17, wherein, when the set temperature is equal to or greater than the limit temperature, the set time interval is fixed, and when the set temperature is less than the limit temperature, the set time interval varies.

19. The refrigerator of claim 17, wherein the set time interval when the set temperature is equal to or greater than the limit temperature is greater than the set time interval when the set temperature is less than the limit temperature.

20. The refrigerator of claim 17, wherein a variable range of the set time interval when the set temperature is equal to or greater than the limit temperature is less than the variable range of the set time interval when the set temperature is less than the limit temperature.

* * * * *